US010210825B2

(12) United States Patent
Tamaki et al.

(10) Patent No.: US 10,210,825 B2
(45) Date of Patent: Feb. 19, 2019

(54) DISPLAY DEVICE

(71) Applicant: Japan Display Inc., Minato-ku (JP)

(72) Inventors: Masaya Tamaki, Tokyo (JP); Tsutomu Harada, Tokyo (JP); Hirotaka Hayashi, Tokyo (JP)

(73) Assignee: Japan Display Inc., Minato-ku (JP)

( * ) Notice: Subject to any disclaimer, the term of this patent is extended or adjusted under 35 U.S.C. 154(b) by 295 days.

(21) Appl. No.: 15/075,991

(22) Filed: Mar. 21, 2016

(65) Prior Publication Data

US 2016/0284288 A1 Sep. 29, 2016

(30) Foreign Application Priority Data

Mar. 26, 2015 (JP) ..... 2015-064514

(51) Int. Cl.

| | |
|---|---|
| ***G02F 1/1362*** | (2006.01) |
| ***G02F 1/1335*** | (2006.01) |
| ***G02F 1/1345*** | (2006.01) |
| ***G09G 3/36*** | (2006.01) |
| ***H01L 27/12*** | (2006.01) |

(52) U.S. Cl.

CPC ..... *G09G 3/3607* (2013.01); *G09G 3/3614* (2013.01); *G09G 3/3677* (2013.01); *G09G 2300/0452* (2013.01); *G09G 2310/0291* (2013.01); *G09G 2320/0209* (2013.01); *G09G 2320/0242* (2013.01); *G09G 2330/021* (2013.01)

(58) Field of Classification Search

CPC ..... H04N 5/268; H01L 27/322

See application file for complete search history.

(56) References Cited

U.S. PATENT DOCUMENTS

| | | | | |
|---|---|---|---|---|
| 8,035,610 | B2 * | 10/2011 | Hsu | G09G 3/3648 345/103 |
| 2003/0043104 | A1 * | 3/2003 | Lee | G02F 1/1345 345/92 |
| 2008/0246720 | A1 * | 10/2008 | Lee | G02F 1/133555 345/96 |
| 2010/0013963 | A1 * | 1/2010 | Jannard | H04N 5/3675 348/242 |
| 2011/0012887 | A1 * | 1/2011 | Lee | G09G 3/3648 345/212 |
| 2011/0134103 | A1 * | 6/2011 | Nam | G09G 3/3648 345/212 |

(Continued)

FOREIGN PATENT DOCUMENTS

| | | |
|---|---|---|
| JP | 2002-62536 | 2/2002 |
| JP | 2004-118048 | 4/2004 |

(Continued)

*Primary Examiner* — Lin Li

(74) *Attorney, Agent, or Firm* — Oblon, McClelland, Maier & Neustadt, L.L.P.

(57) ABSTRACT

According to one embodiment, a display device, includes a first main pixel including first to third sub-pixels, a second main pixel including fourth to sixth sub-pixels, a display driver which produces video signals to be written to the respective sub-pixels of the first and second main pixels and supplies the video signals to the respective sub-pixels via signal lines, any one of the first to third sub-pixels and any one of the fourth to sixth sub-pixels sharing one of the signal lines.

8 Claims, 18 Drawing Sheets

(56) References Cited

U.S. PATENT DOCUMENTS

2011/0242140 A1* 10/2011 Lee ..... G09G 3/3648 345/690
2011/0254879 A1* 10/2011 Mori ..... G09G 3/3607 345/690
2012/0026206 A1* 2/2012 Moon ..... G09G 3/3614 345/690
2012/0098871 A1* 4/2012 Park ..... G09G 3/3607 345/690
2012/0139892 A1* 6/2012 Oh ..... G09G 3/3648 345/212
2012/0212486 A1* 8/2012 Van Der Horst ..... H04N 5/268 345/419
2012/0293476 A1* 11/2012 Lee ..... G09G 3/3614 345/209
2013/0285537 A1* 10/2013 Chaji ..... H01L 27/322 313/504
2014/0054624 A1* 2/2014 Chen ..... H01L 27/156 257/89
2014/0071188 A1* 3/2014 Oh ..... G09G 3/3696 345/691
2014/0210868 A1* 7/2014 Cho ..... G09G 3/3648 345/690
2014/0293181 A1* 10/2014 Lo ..... G02F 1/136286 349/43
2014/0353668 A1* 12/2014 Du ..... H01L 27/124 257/72
2015/0103105 A1* 4/2015 Kim ..... G09G 3/2092 345/690
2015/0187308 A1* 7/2015 Shin ..... G09G 3/3614 345/209
2015/0212376 A1 7/2015 Hayashi

FOREIGN PATENT DOCUMENTS

JP 2011-227140 11/2011
JP 2015-141326 8/2015
KR 20140058252 * 5/2014 ..... G09G 3/3648

* cited by examiner

| Gate | Input data | Line buffer | Display data |
|---|---|---|---|
| G1 | R11 G11 B11 R21 G21 B21 R31 G31 B31 ··· | R11 G11 _ R21 _ B21 _ G31 B31 ··· | B11_ G21_ R31_ ··· |
| G2 | _ | _ _ _ _ _ B21_ G31 ··· | _ G11 R11 R21 B31 ··· |
| G3 | R12 G12 B12 R22 G22 B22 R32 G32 B32 ··· | _ G12 B12 R22 G22 _ R32 _ B32 ··· | R12 B21 B22 G31 G32 ··· |
| G4 | _ | _ _ _ R22_ _ _ B32 ··· | _ B12 G12 G22 R32 ··· |
| G5 | R13 G13 B13 R23 G23 B23 R33 G33 B33 ··· | R13 _B13_ G23 B23 R33 G33_ ··· | G13 R22 R23 B32 B33 ··· |
| G6 | _ | _ _ _ _ _ _R33 G33_ ··· | _ R13 B13 B23 G23 ··· |
| | | | |

FIG. 4

| Gate | Input data | Line buffer | Display data |
|---|---|---|---|
| G1 | R11 G11 B11 R21 G21 B21 R31 G31 B31 ··· | _ G11 _ R21 _ B21 _ G31 _ ··· | R11 _ B11 _ G21 _ R31 _ B31 ··· |
| G2 | _ | | _ G11 _ R21 B21 _ G31··· |
| G3 | R12 G12 B12 R22 G22 B22 R32 G32 B32 ··· | _ _ B12 R22 G22 _ _ _ B32 ··· | R12 G12 _ _ _ B22 R32 G32 ··· |
| G4 | _ | | _ _ B12 R22 G22 _ _ _ B32 ··· |
| G5 | R13 G13 B13 R23 G23 B23 R33 G33 B33 ··· | R13 _ _ _ G23 B23 R33 _ _ ··· | _ G13 B13 R23 _ _ _ G33 B33 ··· |
| G6 | _ | | R13 _ _ _ G23 B23 R33 _ _ ··· |
| | | | |

FIG. 9

DISPLAY DEVICE

CROSS-REFERENCE TO RELATED APPLICATIONS

This application is based upon and claims the benefit of priority from Japanese Patent Application No. 2015-064514, filed Mar. 26, 2015, the entire contents of which are incorporated herein by reference.

FIELD

Embodiments described herein relate generally to a display device.

BACKGROUND

In a liquid crystal display device in a mode of electrically controlled birefringence (ECB) or the like, liquid crystal molecules are undesirably influenced by a lateral electric field due to a relationship between the polarities of adjacent pixels and the rubbing direction of an alignment film, and disclination of the alignment of the liquid crystal molecules occurs in an area in part. The disclination needs to be eliminated since it causes various display failures such as image lag, blurring, reduction in a contrast ratio and the like when an image is displayed.

Use of a light-shielding film or the like to block the light on a portion where the disclination occurs is the most dependable method, but a problem arises in that an area of an opening portion which contributes to the display is reduced as the light-shielding film is extended. Rubbing a pixel polarity in a direction in which no disclination occurs, applying a line-inversion drive scheme, and other methods for dealing with this problem are well known.

Recently, a display device has required a number of signal lines in accordance with the increase in pixels. For this reason, the display device has a problem that the energy consumption is increased.

BRIEF DESCRIPTION OF THE DRAWINGS

FIG. 4 is a table for explanation of an example of a method of writing the video signals to the liquid crystal display panel PNL of the pixel layout shown in FIG. 3.

FIG. 9 is a table for explanation of an example of a method of writing the video signals to the liquid crystal display panel PNL of the pixel layout shown in FIG. 8.

DETAILED DESCRIPTION

Figure 1:
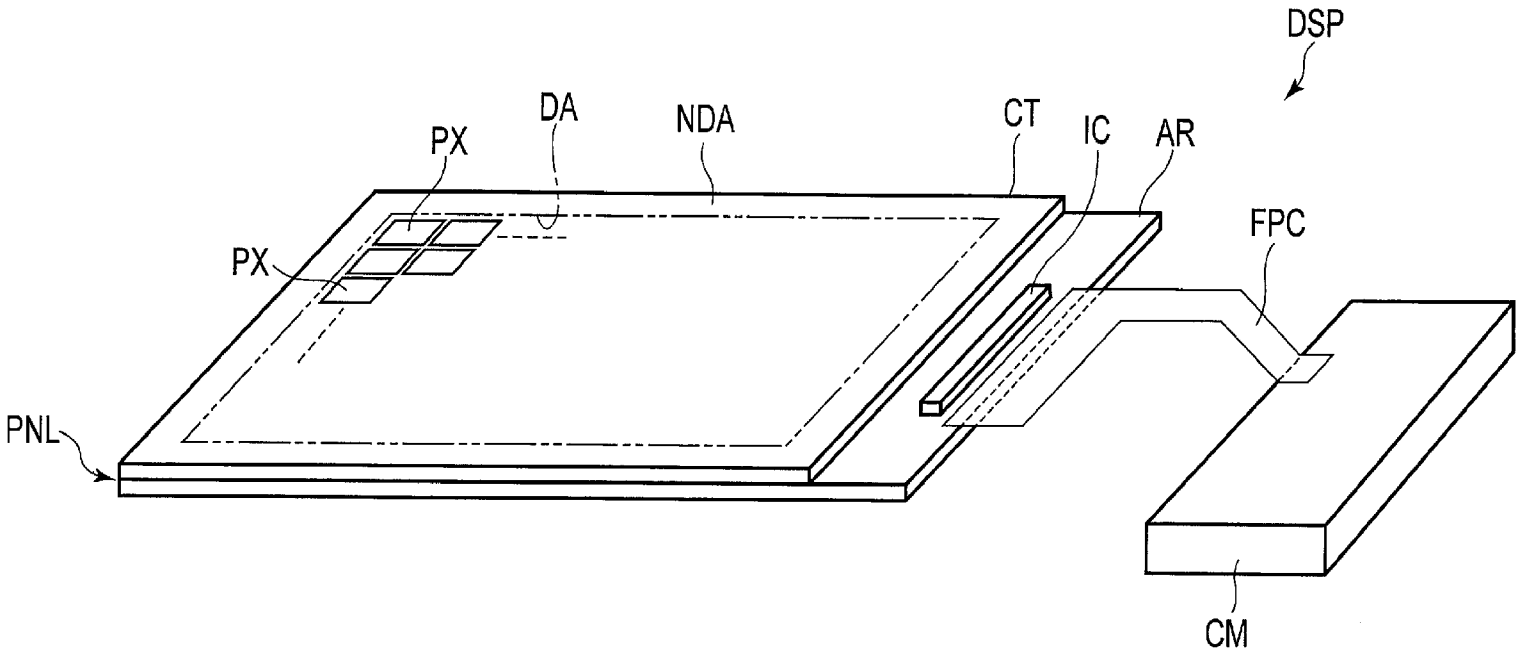
FIG. 1 is a perspective view schematically showing a configuration of a liquid crystal display device DSP.

In general, according to one embodiment, a display device, includes: a first main pixel including a first sub-pixel, a second sub-pixel arranged in a first direction of the first sub-pixel, and a third sub-pixel arranged in a second direction of the first sub-pixel; a second main pixel including a fourth sub-pixel arranged in the first direction of the third sub-pixel, a fifth sub-pixel arranged in the second direction of the third sub-pixel, and a sixth sub-pixel arranged in the first direction of the fifth sub-pixel; a scanning line group including a plurality of scanning lines; a signal line group including a plurality of signal lines; and a display driver which produces video signals to be written to the respective sub-pixels of the first and second main pixels and supplies the video signals to the respective sub-pixels via the signal lines, any one of the first to third sub-pixels and any one of the fourth to sixth sub-pixels sharing one of the signal lines.

Embodiments will be described hereinafter with reference to the accompanying drawings. The disclosure is merely an example, and proper changes within the spirit of the invention, which are easily conceivable by a skilled person, are included in the scope of the invention as a matter of course. In addition, in some cases, in order to make the description clearer, the widths, thicknesses, shapes, etc., of the respective parts are schematically illustrated in the drawings, compared to the actual modes. However, the schematic illustration is merely exemplary, and adds no restrictions to the interpretation of the invention. In each drawing, like or similar elements disposed sequentially may not be denoted by reference numbers or symbols. Furthermore, in the specification and drawings, constituent elements having the same or similar functions as those described in connection with preceding drawings are denoted by like reference numerals and duplicated detailed explanations may be arbitrarily omitted.

In the embodiments, a liquid crystal display device is described as an example of the display device. The liquid crystal display device can be used in, for example, various types of equipment such as smartphones, tablet terminals, mobile telephone terminals, personal computers, TV receivers, in-car equipment and game consoles. The major configuration explained in the present embodiment can also be applied to a self-luminous display device comprising an organic electroluminescent display element, and the like, an electronic paper display device comprising a cataphoretic element, and the like, a display device employing microelectromechanical systems (MEMS), or a display device employing electrochromism.

FIG. 1 is a perspective view schematically showing a configuration of a liquid crystal display device DSP.

The liquid crystal display device DSP comprises an active-matrix liquid crystal display panel PNL, a driving IC chip IC which drives the liquid crystal display panel PNL, a control module CM, a flexible printed-circuit board FPC and the like.

The liquid crystal display panel PNL includes an array substrate (first substrate) AR and a counter-substrate (second substrate) CT disposed to be opposed to the array substrate AR. The liquid crystal display panel PNL includes a display area DA in which an image is displayed and a frame-shaped non-display area NDA surrounding the display area DA. The liquid crystal display panel PNL includes a plurality of main pixels (or unit pixels) PX arrayed in a matrix in the display area DA. The driving IC chip IC is mounted on the array substrate AR. The flexible printed-circuit board FPC connects the liquid crystal display panel PNL with the control module CM.

For example, the liquid crystal display panel PNL is a reflective display panel having a reflective display function of displaying an image by selectively reflecting light incident from the display surface side, such as external light and auxiliary light on each of the main pixels PX. In the reflective liquid crystal display panel PNL, a front light unit may be disposed as an auxiliary light source, on a side opposed to the counter-substrate CT. The liquid crystal display panel PNL may be a transmissive display panel having a transmissive display function of displaying an image by selectively transmitting the light from a backlight unit disposed on a back surface side of the array substrate AR by each main pixel PX or a transreflective display panel having a transmissive display function and a reflective display function.

For example, the main pixel PX which is a minimum unit constituting a color image includes a sub-pixel PR which exhibits a red color, a sub-pixel PG which exhibits a green color, and a sub-pixel PB which exhibits a blue color, as explained later. The main pixel PX may further include sub-pixels of the other colors (for example, yellow, pale blue, pale red, substantially transparent, white and the like).

Figure 2:
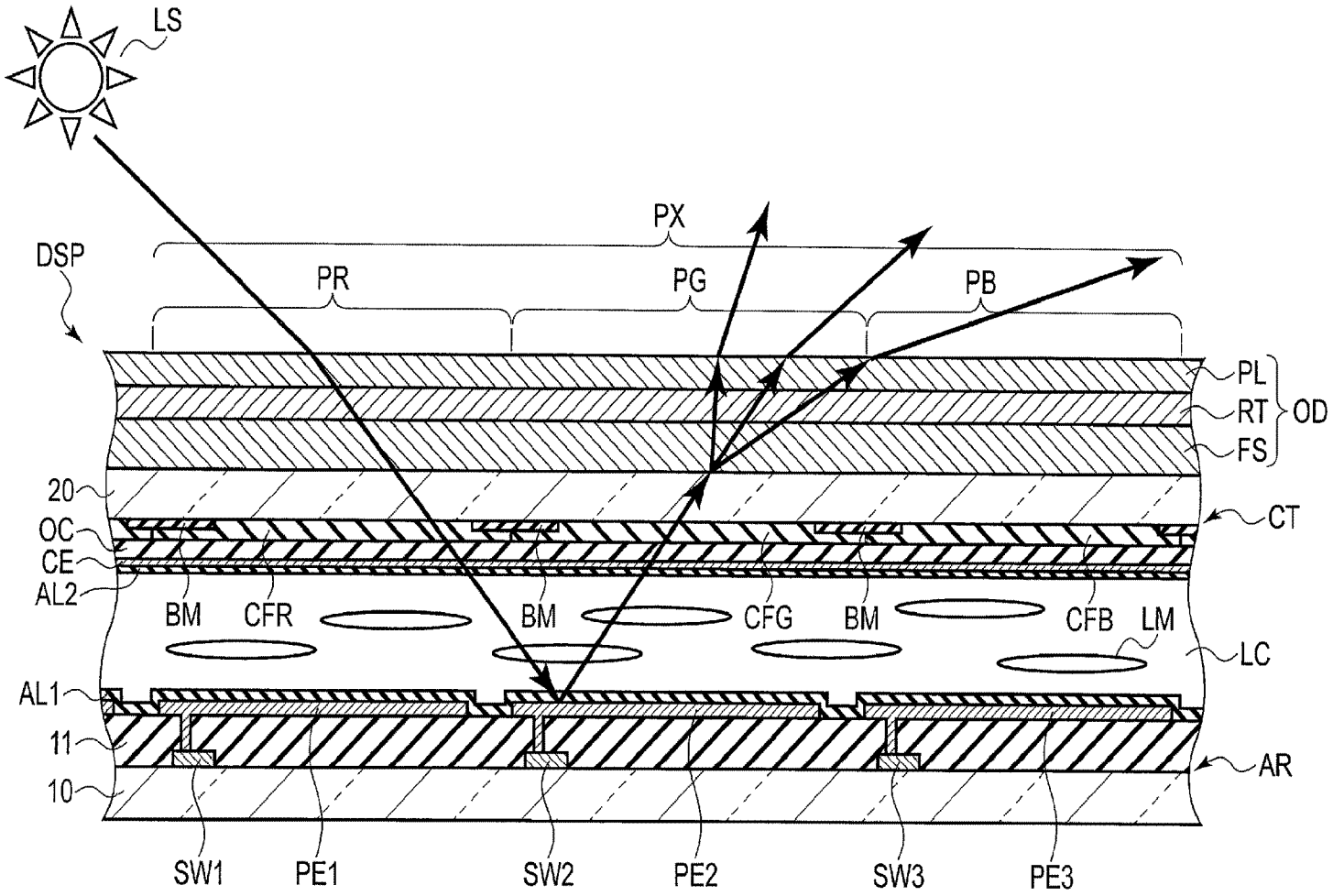
FIG. 2 is a schematic view showing a cross-section of the liquid crystal display panel DSP.

FIG. 2 is a schematic view showing a cross-section of the liquid crystal display panel DSP. The liquid crystal display device DSP comprising the reflective liquid crystal display panel PNL, in which one main pixel PX includes the sub-pixels PR, PG and PB, will be explained here.

The liquid crystal display device DSP comprises the array substrate AR, the counter-substrate CT, a liquid crystal layer LC, and an optical element OD.

The array substrate AR includes a first insulating substrate 10, switching elements SW1 to SW3, an interlayer insulating film 11, pixel electrodes (reflecting electrodes) PE1 to PE3, a first alignment film AL1 and the like. The switching elements SW1 to SW3 are formed on a side of the first insulating substrate 10, which is opposed to the counter-substrate CT. The switching element SW1 is disposed on the sub-pixel PR, the switching element SW2 is disposed on the sub-pixel PG, and the switching element SW3 is disposed on the sub-pixel PB. The interlayer insulating film 11 covers the switching elements SW1 to SW3 and the first insulating substrate 11. The pixel electrodes PE1 to PE3 are formed on a side of the interlayer insulating film 11, which is opposed to the counter-substrate CT. Each of the pixel electrodes PE1 to PE3 includes a reflective layer formed of, for example, a metal material such as aluminum or silver, which has a light reflection property. The pixel electrodes PE1 to PE3 or reflective layers have substantially flat surfaces (specular surfaces). The pixel electrode PE1 is disposed in the sub-pixel PR and electrically connected with the switching element SW1. The pixel electrode PE2 is disposed in the sub-pixel PG and electrically connected with the switching element SW2. The pixel electrode PE3 is disposed in the sub-pixel PB and electrically connected with the switching element SW3. The first alignment film AL1 covers the pixel electrodes PE1 to PE3 and the interlayer insulating film 11.

The counter-substrate CT includes a second insulating substrate 20, a light-shielding layer BM, color filters CFR, CFG and CFB, an overcoat layer OC, a common electrode CE, a second alignment film AL2, and the like. The light-shielding layer BM is formed on a side of the second insulating substrate 20, which is opposed to the array substrate AR. The color filters CFR, CFG and CFB are formed on a side of the second insulating substrate 20, which is opposed to the array substrate AR, and partially overlap the light-shielding layer BM. The color filter CFR is a red color filter disposed in the sub-pixel PR and opposed to the pixel electrode PE1. The color filter CFG is a green color filter disposed in the sub-pixel PG and opposed to the pixel electrode PE2. The color filter CFB is a blue color filter disposed in the sub-pixel PB and opposed to the pixel electrode PE3. If the main pixel PX further includes a sub-pixel of the other color, a color filter of the corresponding color is disposed in the sub-pixel. For example, the main pixel PX may further include a color filter of yellow, pale blue or pale red or a substantially transparent or white color filter as a color filter of the other color different from red, green and blue. The color filters CF are disposed to correspond to the sub-pixels which exhibit the respective colors. The overcoat layer OC covers the color filters CF. The common electrode CE is formed on a side of the overcoat layer OC, which is opposed to the array substrate AR. The common electrode CE is disposed over the entire area of the main pixel PX and opposed to the pixel electrodes PE1 to PE3. The common electrode CE is formed of a transparent conductive material such as indium tin oxide (ITO) or indium zinc oxide (IZO). The second alignment film AL2 covers the common electrode CE.

The array substrate AR and the counter-substrate CT are adhered to each other such that the first alignment film AL1 and the second alignment film AL2 are opposed to each other. The liquid crystal layer LC is held between the array substrate AR and the counter-substrate CT, and includes liquid crystal molecules LM located between the first alignment film AL1 and the second alignment film AL2.

The optical element OD is disposed on a side opposite to a surface of the counter-substrate CT, which is in contact with the liquid crystal layer LC. The optical element OD includes, for example, a forward-scattering film FS, a retardation film RT, a polarizer PL and the like. The forward-scattering film FS is adhered to, for example, the second insulating substrate 20. The forward-scattering film FS has a function of transmitting light incident from a specific direction (i.e., a light source LS side in the figure) and scattering light incident from the other specific direction, as shown in the figure. It is desirable to stack a plurality of forward-scattering films FS for the purpose of extending the range of diffusion, preventing rainbow hues and the like. The retardation film RT is stacked on the forward-scattering film FS. The retardation film RT is a quarter-wave plate. For example, the retardation film RT is constituted by stacking a quarter-wave plate and a half-wave plate so as to reduce a wavelength dependency and obtain a desired phase difference within a wavelength range used for color display. The polarizer PL is stacked on the retardation film RT. The forward-scattering film FS may not only be located at the position shown in the figure, but may also be stacked on the polarizer PL.

Figure 3:
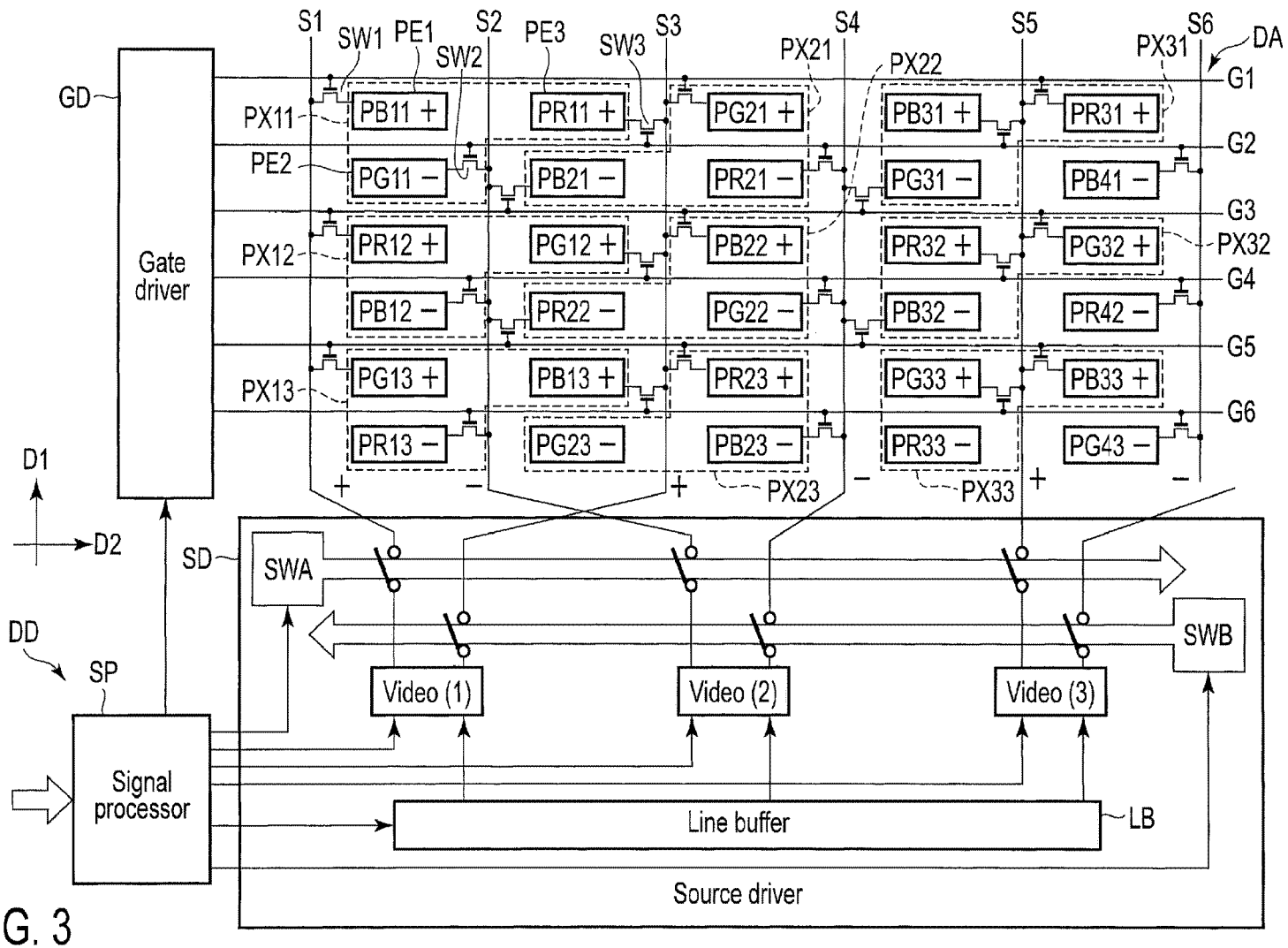
FIG. 3 is a diagram schematically showing an example of a pixel layout in the display area, and a configuration for writing video signals to respective pixels.

FIG. 3 is a diagram schematically showing an example of a pixel layout in the display area, and a configuration for writing video signals to respective pixels.

A part of the display area DA shown in the figure includes a scanning line group including a plurality of scanning lines G1 to G6, a signal line group including a plurality of signal lines S1 to S6, and a plurality of main pixels PX. The scanning lines G1 to G6 extend substantially along a second direction D2 so as to be arranged in a first direction D1. The signal lines S1 to S6 extend substantially along the first direction D1 so as to be arranged in the second direction D2. The first direction D1 and the second direction D2 are perpendicular to each other.

In the pixel layout shown in the figure, some main pixels in the display area DA, i.e., main pixels PX11 to PX13 and PX21 to PX23 are illustrated. The main pixels PX11 to PX13, PX21 to PX23 and PX31 to PX33 are arranged in the first direction D1. The main pixels PX11, PX21 and PX31 are arranged in the second direction D2. Similarly, the main pixels PX12, PX22 and PX32 are arranged in the second direction D2, and the main pixels PX13, PX23 and PX33 are also arranged in the second direction D2.

When the main pixel PX11 is noticed, the main pixel PX11 includes a sub-pixel (first sub-pixel) PB11, a sub-pixel (second sub-pixel) PG11 and a sub-pixel (third sub-pixel) PR11. The sub-pixel PG11 and the sub-pixel PB11 are arranged in the first direction D1. The sub-pixel PR11 and the sub-pixel PB11 are arranged in the second direction D2. The sub-pixel PB11 comprises the switching element SW1 and the pixel electrode PE1. The switching element SW1 is electrically connected with the scanning line G1 and the signal line S1. The pixel electrode PE1 is electrically connected with the switching element SW1. The sub-pixel PG11 comprises the switching element SW2 and the pixel electrode PE2. The switching element SW2 is electrically connected with the scanning line G2 and the signal line S2. The pixel electrode PE2 is electrically connected with the switching element SW2. The sub-pixel PR11 comprises the switching element SW3 and the pixel electrode PE3. The switching element SW3 is electrically connected with the scanning line G2 and the signal line S3. The pixel electrode PE3 is electrically connected with the switching element SW3.

Each of the other main pixels also includes three sub-pixels. In the figure, PRn, PGn and PBn indicate a red sub-pixel, a green sub-pixel and a blue sub-pixel, respectively, in each main pixel PXn, where n indicates a positive integer. In the pixel layout shown in the figure, each of the sub-pixels is in a laterally elongated shape extending in the second direction D2.

When the main pixel PX21 is noticed, the main pixel PX21 includes a sub-pixel (fourth sub-pixel) PB21, a sub-pixel (fifth sub-pixel) PG21 and a sub-pixel (sixth sub-pixel) PR21. The sub-pixel PB21 and the sub-pixel PR11 are arranged in the first direction D1. The sub-pixel PG21 and the sub-pixel PR11 are arranged in the second direction D2. The sub-pixel PR21 and the sub-pixel PG21 are arranged in the first direction D1. The switching element of the sub-pixel PB21 is electrically connected with the scanning line G3, the signal line S2 and the pixel electrode. Hereinafter, this connection state will simply be explained similarly to a phrase "the sub-pixel PB21 is electrically connected with the scanning line G3 and the signal line S2". The sub-pixel PG21 is electrically connected with the scanning line G1 and the signal line S3. The sub-pixel PR21 is electrically connected with the scanning line G2 and the signal line S4.

When the main pixel PX31 is noticed, the main pixel PX31 includes sub-pixels PB31, PG31 and PR31. The sub-pixel PG31 and the sub-pixel PB31 are arranged in the first direction D1. The sub-pixel PR31 and the sub-pixel PB31 are arranged in the second direction D2. The sub-pixel PB31 is electrically connected with the scanning line G2 and the signal line S5. The sub-pixel PG31 is electrically connected with the scanning line G3 and the signal line S4. The sub-pixel PR31 is electrically connected with the scanning line G1 and the signal line S5.

The main pixels PX12, PX22 and PX32 arranged in the second direction D2 are constituted similarly to the main pixels PX11, PX21 and PX31. Similarly to this, the main pixels PX13, PX23 and PX33 are constituted similarly to the main pixels PX11, PX21 and PX31.

A display driver DD supplies various signals to display images to the display area DA of this pixel layout. The display driver DD comprises a signal processor SP, a gate driver GD, a source driver SD and the like. The signal processor SP processes input signals from the outside and controls the gate driver GD, the source driver SD and the like. In addition, the signal processor SP produces a video signal which is to be written to each sub-pixel. The scanning lines G1 to G6 are connected to the gate driver GD. The gate driver GD sequentially outputs control signals to the scanning lines G1 to G6, under control of the signal processor SP. The signal lines S1 to S6 are connected to the source driver SD. The source driver SD comprises output terminals Video (1) to Video (3) which output the video signals produced by the signal processor SP to the respective signal lines S1 to S6.

More specifically, the line buffer LB is built in the source driver SD. In the source driver SD, the output terminals Video (1) to Video (3) are electrically connected with the line buffer LB and the signal processor SP. In addition, the output terminal Video (1) is electrically connected with the signal lines S1 and S3, the output terminal Video (2) is electrically connected with the signal lines S2 and S4, and the output terminal Video (3) is electrically connected with the signal line S5 and a signal line S7 (not shown). A switch SWA which is switched to be on (conductive state) or off (nonconductive state) in the same period is interposed between the signal line S1 and the output terminal Video (1), between the signal line S2 and the output terminal Video (2), and between the signal line S5 and the output terminal Video (3). A switch SWB which is switched to be on (conductive state) or off (nonconductive state) in the same period is interposed between the signal line S3 and the output terminal Video (1), between the signal line S4 and the output terminal Video (2), and between the signal line S7 and the output terminal Video (3). The switches SWA and SWB are controlled to be on and off by, for example, the signal processor SP.

The signal processor SP outputs some of the video signals to the output terminals Video (1) to Video (3) while outputting the other video signals to the line buffer LB. The line buffer LB temporarily stores the video signals input from the signal processor SP. For example, the signal processor SP produces video signals for one pixel line and outputs the video signals for one third pixel line to the output terminals Video (1) to Video (3) while outputting the video signals for remaining two third pixel lines to the line buffer LB and temporarily storing the video signals in the line buffer LB. For this reason, the line buffer LB may have a storage capacity to store video signals for at least two third pixel lines. Outputting the video signals will be explained later.

In this configuration, the polarities of the video signals output to each of the signal lines S1 to S6, in one frame period, are not varied, and the polarities of the video signals output to adjacent signal lines are opposite. In the example illustrated, the polarities of the video signals output to the odd-numbered signal lines S1, S3 and S5 are positive (+) and the polarities of the video signals output to the even-numbered signal lines S2, S4 and S6 are negative (−), in a certain frame period. In one frame period subsequent to the frame period shown in the figure, polarities of the video signals output to the odd-numbered signal lines are negative (−), and polarities of the video signals output to the even-numbered signal lines are positive (+). In other words, the column-inversion drive scheme is applied to the present configuration.

In contrast, the polarities of the video signals written to the sub-pixels of the respective pixel lines are the same as each other, and the polarities of the video signals of the adjacent pixel lines are opposite to each other, in the frame period shown in the figure. In the example illustrated, the polarities of the video signals written to the sub-pixels of the odd-numbered pixel lines, for example, the sub-pixels PB11, PR11, PG21, PB31 and PR31 are positive (+), and the polarities of the video signals written to the sub-pixels of the even-numbered pixel lines, for example, the sub-pixels PG11, PB21, PR21, PG31 and PB41 are negative (−). In one frame period subsequent to the frame period shown in the figure, the polarities of the video signals of the odd-numbered pixel lines are negative (−), and the polarities of the video signals of the even-numbered pixel lines are positive (+). In other words, the polarity distribution equivalent to that of the line-inversion drive scheme can be obtained in the present configuration.

The positive polarity of the video signal indicates that the potential of the video signal written to the pixel electrode PE is high with respect to the potential of the common electrode CE, and the negative polarity of the video signal indicates that the potential of the video signal written to the pixel electrode PE is low with respect to the potential of the common electrode CE.

FIG. 4 is a table for explanation of an example of a method of writing the video signals to the liquid crystal display panel PNL of the pixel layout shown in FIG. 3.

In the figure, column "Gate" indicates periods for causing the switching elements connected to the respective scanning lines to be conductive and writing the video signals via the switching elements (i.e., horizontal scanning periods in which the scanning lines G1 to G6 are selected, respectively). Column "input data" indicates the video signals supplied from the signal processor SP to the source driver SD. It should be noted that "Rn", "Gn" and "Bn" represent the video signals written to the pixel electrodes of the sub-pixels PRn, PGn and PBn, respectively, and that the polarities of underlined video signals are different from those of non-underlined video signals. For example, the non-underlined video signals are assumed to have positive polarities and the underlined video signals are assumed to have negative polarities. In the present example, n is a positive integer. Column "line buffer" indicates the video signals temporarily stored in the line buffer LB, of the video signals of the input data. Column "display data" indicates the video signals supplied to the liquid crystal display panel PNL via the output terminals, of the video signals of the input data.

In the horizontal scanning period in which the scanning line G1 is selected, the signal processor SP produces the video signals (R11, G11, B11, R21, G21, B21, R31, G31, B31, . . . ) corresponding to the main pixels PX11, PX21 and PX31 as the input data and supplies the video signals to the source driver SD. At this time, the signal processor SP supplies the video signals (B11, G21, R31, . . . ) to the liquid crystal display panel PNL while supplying the video signals (R11, G11, R21, B21, G31, B31, . . . ) to the line buffer LB. The video signals are thereby written to the sub-pixels PB11, PG21 and PR31, respectively. The line buffer LB temporarily stores the video signals (R11, G11, R21, B21, G31, B31, . . . ).

In the horizontal scanning period in which the scanning line G2 is selected, the source driver SD supplies the video signals (R11, G11, R21, B31, . . . ), of the video signals stored in the line buffer LB, to the liquid crystal display panel PNL. The video signals are thereby written to the sub-pixels PR11, PG11, PR21 and PB31, respectively.

In the horizontal scanning period in which the scanning line G3 is selected, the signal processor SP produces the video signals (R12, G12, B12, R22, G22, B22, R32, G32, B32, . . . ) corresponding to the main pixels PX12, PX22 and PX32 as the input data and supplies the video signals to the source driver SD. At this time, the signal processor SP supplies the video signals (R12, B22, G32, . . . ) to the liquid crystal display panel PNL while supplying the video signals (G12, B12, R22, G22, R32, B32, . . . ) to the line buffer LB. The line buffer LB temporarily stores the video signals (G12, B12, R22, G22, R32, B32, . . . ) from the signal processor SP after outputting the stored video signals (B21, G31, . . . ) to the liquid crystal display panel PNL. The video signals are thereby written to the sub-pixels PR12, PB21, PB22, PG31 and PG32, respectively.

In the horizontal scanning period in which the scanning line G4 is selected, the source driver SD supplies the video signals (G12, B12, G22, R32, . . . ), of the video signals stored in the line buffer LB, to the liquid crystal display panel PNL. The video signals are thereby written to the sub-pixels PG12, PB12, PG22 and PR32, respectively.

In the horizontal scanning period in which the scanning line G5 is selected, the signal processor SP produces the video signals (R13, G13, B13, R23, G23, B23, R33, G33, B33, . . . ) corresponding to the main pixels PX13, PX23 and PX33 as the input data and supplies the video signals to the source driver SD. At this time, the signal processor SP supplies the video signals (G13, R23, B33, . . . ) to the liquid crystal display panel PNL while supplying the video signals (R13, B13, G23, B23, R33, G33, . . . ) to the line buffer LB. The line buffer LB temporarily stores the video signals (R13, B13, G23, B23, R33, G33, . . . ) from the signal processor SP after outputting the stored video signals (R22, B32, . . . ) to the liquid crystal display panel PNL. The video signals are thereby written to the sub-pixels PG13, PR22, PR23, PB32 and PB33, respectively.

In the horizontal scanning period in which the scanning line G6 is selected, the source driver SD supplies the video signals (R13, B13, G23, B23, . . . ), of the video signals stored in the line buffer LB, to the liquid crystal display panel PNL. The video signals are thereby written to the sub-pixels PR13, PB13, PG23 and PB23, respectively.

Figure 5:
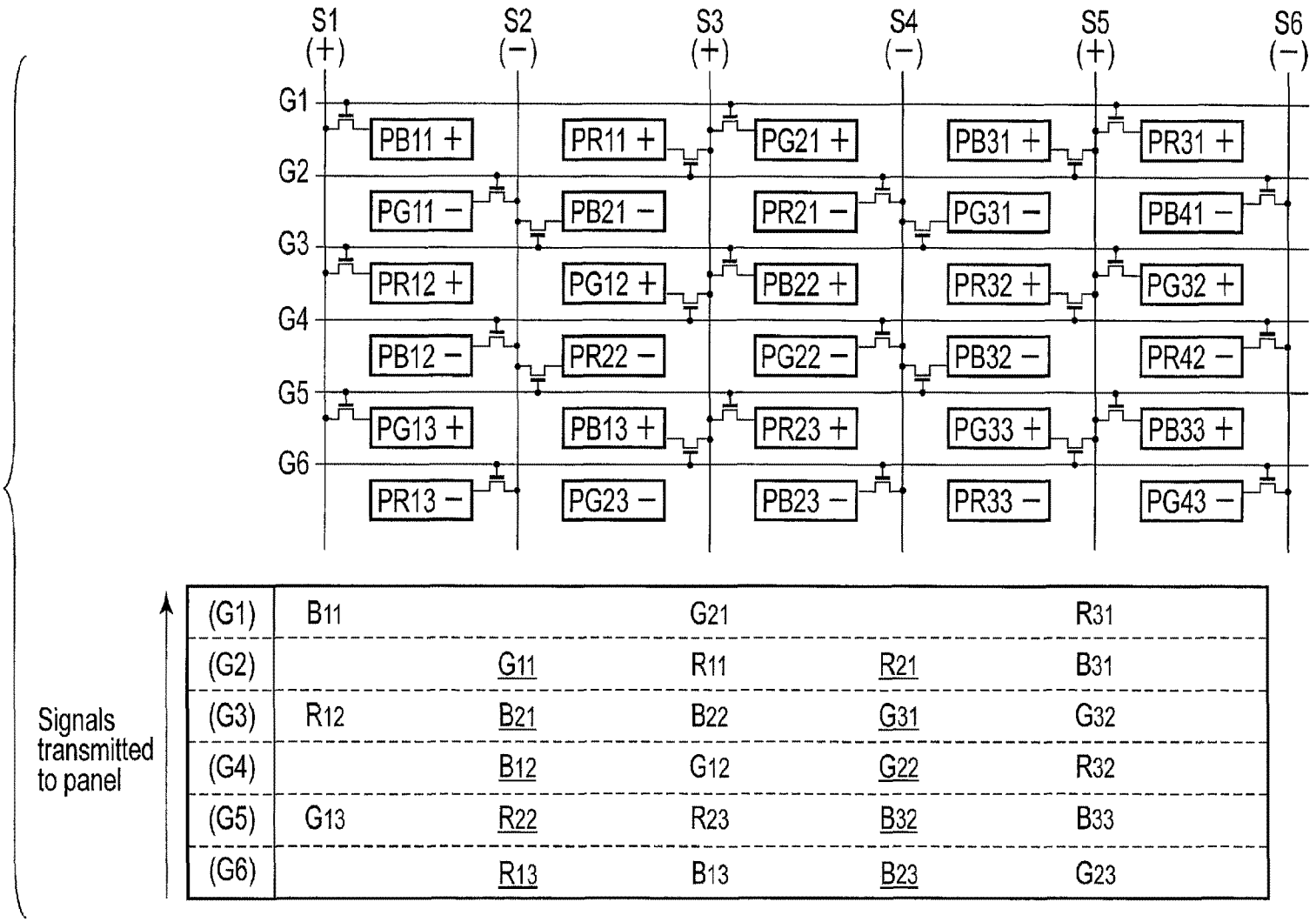
FIG. 5 is an illustration showing the polarities of the video signals output to each signal line by the writing method explained with reference to FIG. 4.

FIG. 5 is an illustration showing the polarities of the video signals output to each signal line by the writing method explained with reference to FIG. 4.

In the horizontal scanning period in which the scanning line G1 is selected, the video signal B11 is output to the signal line S1, the video signal G21 is output to the signal line S3, and the video signal R31 is output to the signal line S5.

In the horizontal scanning period in which the scanning line G2 is selected, the video signal G11 is output to the signal line S2, the video signal R11 is output to the signal line S3, the video signal R21 is output to the signal line S4, and the video signal B31 is output to the signal line S5.

In the horizontal scanning period in which the scanning line G3 is selected, the video signal R12 is output to the signal line S1, the video signal B21 is output to the signal line S2, the video signal B22 is output to the signal line S3, the video signal G31 is output to the signal line S4, and the video signal G32 is output to the signal line S5.

In the horizontal scanning period in which the scanning line G4 is selected, the video signal B12 is output to the signal line S2, the video signal G12 is output to the signal line S3, the video signal G22 is output to the signal line S4, and the video signal R32 is output to the signal line S5.

In the horizontal scanning period in which the scanning line G5 is selected, the video signal G13 is output to the signal line S1, the video signal R22 is output to the signal line S2, the video signal R23 is output to the signal line S3, the video signal B32 is output to the signal line S4, and the video signal B33 is output to the signal line S5.

In the horizontal scanning period in which the scanning line G6 is selected, the video signal R13 is output to the signal line S2, the video signal B13 is output to the signal line S3, the video signal B23 is output to the signal line S4, and the video signal G23 is output to the signal line S5.

When the polarities of the video signals output to the signal lines S1, S3 and S5 are noticed, all the polarities are the same and positive (+) in one frame period, in the example illustrated. In addition, when the polarities of the video signals output to the signal lines S2, S4 and S6 are noticed, all the polarities are the same and negative (−) in one frame period, in the example illustrated.

When the main pixel PX11 is noticed, the video signal B11 is written to the sub-pixel PB11 in the horizontal scanning period in which the scanning line G1 is selected, and the video signals G11 and R11 are written to the sub-pixels PG11 and PR11, respectively, in the horizontal scanning period in which the scanning line G2 is selected, as shown in the figure. In other words, the horizontal scanning periods for at least two pixel lines are required to write the video signals to all the sub-pixels constituting the main pixel PX11. In contrast, when the main pixel PX22 is noticed, the video signal B22 is written to the sub-pixel PR22 in the horizontal scanning period in which the scanning line G3 is selected, the video signals G22 is written to the sub-pixels PG22 in the horizontal scanning period in which the scanning line G4, and the video signal R22 is written to the sub-pixel PR22 in the horizontal scanning period in which the scanning line G5 is selected. In other words, the horizontal scanning periods for at least three pixel lines are required to write the video signals to all the sub-pixels constituting the main pixel PX22.

Figure 6:
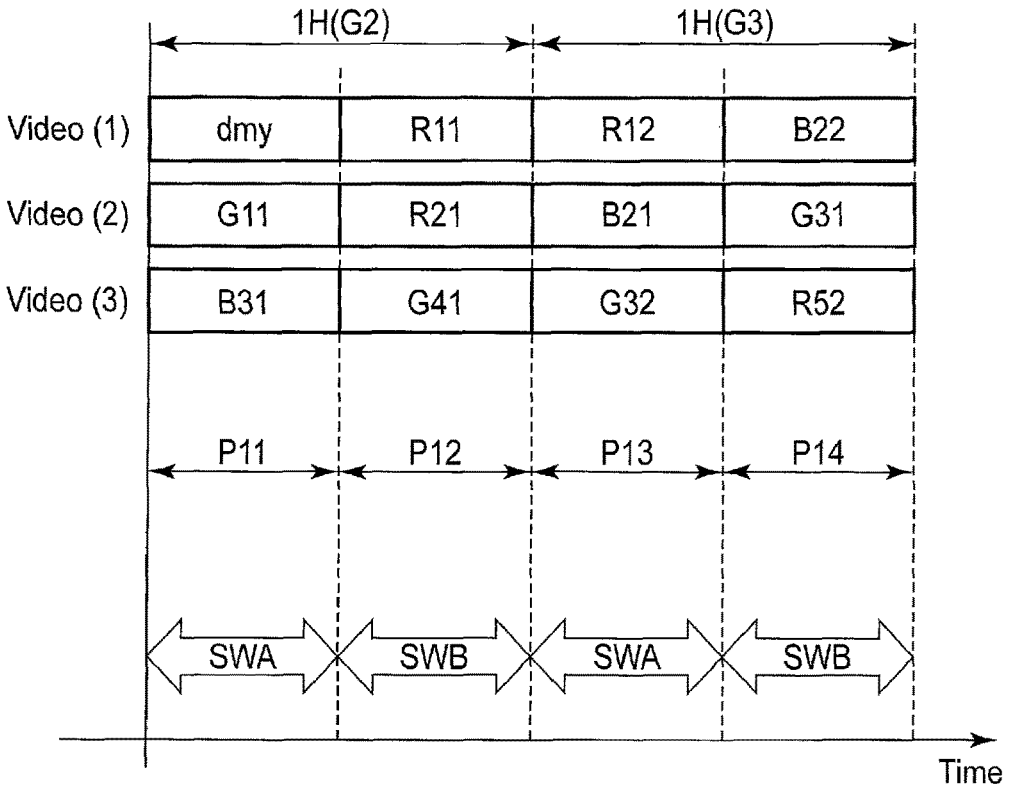
FIG. 6 is an illustration showing an example of timing of writing the video signals to the respective sub-pixels of the pixel layout shown in FIG. 3.

FIG. 6 is an illustration showing an example of timing of writing the video signals to the respective sub-pixels of the pixel layout shown in FIG. 3.

The horizontal scanning period 1H(G2) in which the scanning line G2 is selected includes a first period P11 and a second period P12 subsequent to the first period P11. The horizontal scanning period 1H(G3) in which the scanning line G3 is selected includes a third period P13 and a fourth period P14 subsequent to the third period P13. The first period P11 and the third period P13 are periods in which the switch SWA is conductive and the switch SWB is non-conductive. The second period P12 and the fourth period P14 are periods in which the switch SWB is conductive and the switch SWA is non-conductive.

In the first period P11, the output terminal Video (1) is electrically connected with the signal line S1, the output terminal Video (2) is electrically connected with the signal line S2, and the output terminal Video (3) is electrically connected with the signal line S5. A dummy video signal dmy output from the output terminal Video (1) is output to the signal line S1. The video signal G11 output from the output terminal Video (2) is written to the sub-pixel PG11 via the signal line S2. The video signal B31 output from the output terminal Video (3) is written to the sub-pixel PB31 via the signal line S5.

In the second period P12, the output terminal Video (1) is electrically connected with the signal line S3, the output terminal Video (2) is electrically connected with the signal line S4, and the output terminal Video (3) is electrically connected with the signal line S7. The video signal R11 output from the output terminal Video (1) is written to the sub-pixel PR11 via the signal line S3. The video signal R21 output from the output terminal Video (2) is written to the sub-pixel PR21 via the signal line S4. The video signal G41 output from the output terminal Video (3) is written to the sub-pixel PG41 via the signal line S7.

In the third period P13, similarly to the first period P11, the output terminal Video (1) is electrically connected with the signal line S1, the output terminal Video (2) is electrically connected with the signal line S2, and the output terminal Video (3) is electrically connected with the signal line S5. The video signal R12 output from the output terminal Video (1) is written to the sub-pixel PR12 via the signal line S1. The video signal B21 output from the output terminal Video (2) is written to the sub-pixel PB21 via the signal line S2. The video signal G32 output from the output terminal Video (3) is written to the sub-pixel PG32 via the signal line S5.

In the fourth period P14, similarly to the second period P12, the output terminal Video (1) is electrically connected with the signal line S3, the output terminal Video (2) is electrically connected with the signal line S4, and the output terminal Video (3) is electrically connected with the signal line S7. The video signal B22 output from the output terminal Video (1) is written to the sub-pixel PB22 via the signal line S3. The video signal G31 output from the output terminal Video (2) is written to the sub-pixel PG31 via the signal line S4. The video signal R42 output from the output terminal Video (3) is written to a sub-pixel PR52 via the signal line S7.

According to the present embodiment, one of the sub-pixels constituting one main pixel, and one of the sub-pixels constituting the other main pixel, of two main pixels arranged in the second direction D2, share the same signal line. For this reason, the number of the signal lines allocated to the two main pixels arranged in the second direction D2 is smaller than the total number of the sub-pixels constituting the two main pixels. In other words, the number of the signal lines allocated to one main pixel PX is smaller than the total number of the sub-pixels constituting the main pixel PX. In the example shown in FIG. 3, the signal lines S1 to S3 are arranged for totally six sub-pixels when two main pixels PX11 and PX21 arranged in the second direction D2 are paired as a minimum unit of repetition. The signal line S2 is electrically connected with the sub-pixel PG11 constituting the main pixel PX11 and the sub-pixel PB21 constituting the main pixel PX21, and is shared by the sub-pixels PG11 and PB21. In addition, the signal line S3 is electrically connected with the sub-pixel PR11 constituting the main pixel PX11 and the sub-pixel PG21 constituting the main pixel PX21, and is shared by the sub-pixels PR11 and PG21. The sub-pixel PR21 is electrically connected with the signal line S4, but the signal line S4 is shared by the sub-pixel PR21 and the sub-pixel PG31 of the main pixel PX31, which is arranged with the sub-pixel PR21 in the second direction D2, and is not included in the signal lines allocated to the main pixels PX11 and PX21. Thus, three signal lines are allocated to every two main pixels, i.e., one and a half signal lines are allocated to each main pixel. Even if the number of the main pixels which should be disposed in the display area is increased, increase in the number of signal lines can be suppressed and the energy consumption can be reduced.

In addition, the polarities of the video signals output to each signal line are not varied in one frame period, and the polarities of the video signals of the signal lines adjacent in the second direction D2 are opposite to each other. In other words, the column-inversion drive scheme is applied to the present embodiment. For this reason, the energy consumption can be reduced in comparison with application of the line-inversion drive scheme of supplying the video images having the polarities inverted in each one or more pixel lines for the same signal line.

In the above-explained example, two signal lines are connected to each output terminal Video via the switches and one horizontal scanning period is divided into two periods to output the video signals to each of the signal lines, but at least three signal lines may be connected to one output terminal Video via the switches and, in this case, one horizontal scanning period may be divided into a necessary number of periods to output the video signals to each of the signal lines.

Next, another configuration example of the present embodiment will be explained.

Figure 7:
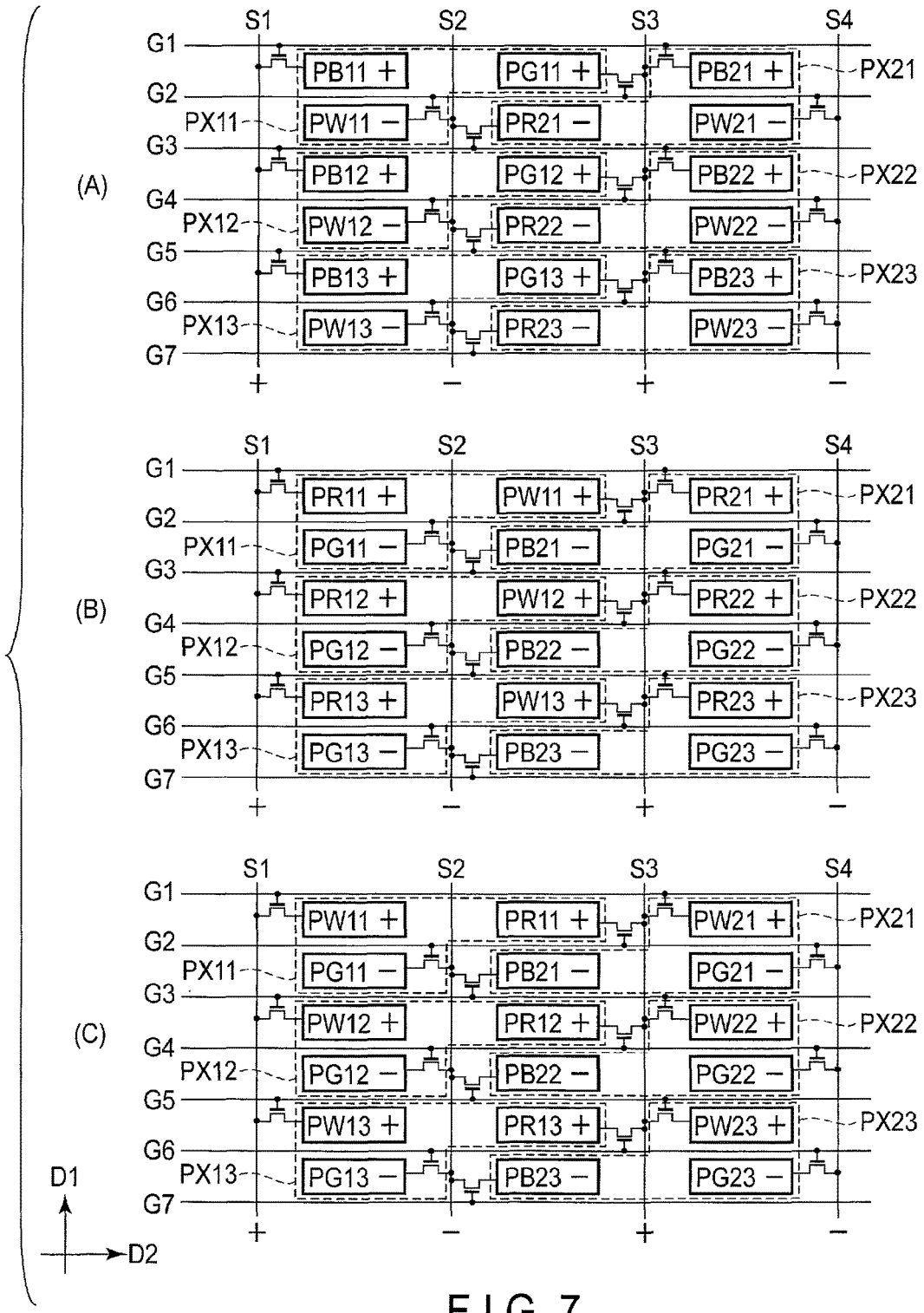
FIG. 7 is an illustration schematically showing a relationship between another pixel layout in the display area, and the polarities of the video signals written to the respective pixels.

FIG. 7 is an illustration schematically showing a relationship between another pixel layout in the display area, and the polarities of the video signals written to the respective pixels.

Some main pixels in the display area are shown in the pixel layout illustrated in each of (A) to (C) in the figure, the main pixels PX11 to PX13 and PX21 to PX23 are arranged in the first direction D1, and the main pixels PX11 and PX21, the main pixels PX12 and PX22, and the main pixels PX13 and PX23 are arranged in the second direction D2.

In the pixel layout illustrated in (A), the main pixel PX11 includes the sub-pixels PB11, PW11 and PG11. The main pixel PX21 includes the sub-pixels PR21, PB21 and PW21. The main pixels PX12 and PX13 are also constituted similarly to the main pixel PX11, and the main pixels PX22 and PX23 are also constituted similarly to the main pixel PX21. In the figure, PRn, PGn, PBn and PWn indicate a red sub-pixel, a green sub-pixel, a blue sub-pixel and a sub-pixel of a fourth color (for example, white), respectively, in each main pixel PXn, where n indicates a positive integer. The other configuration examples to be explained below also have the same feature as this.

Two main pixels arranged in the second direction D2 function as a pair of unit pixels and share sub-pixels of colors removed from the respective main pixels. In the example illustrated, the green sub-pixel PG11 and the red sub-pixel PR21 are shared in the unit pixel composed of the main pixels PX11 and PX21.

In the main pixel PX11, the sub-pixel PB11 is electrically connected with the scanning line G1 and the signal line S1. The sub-pixel PW11 is electrically connected with the scanning line G2 and the signal line S2. The sub-pixel PG11 is electrically connected with the scanning line G2 and the signal line S3.

In the main pixel PX21, the sub-pixel PR21 is electrically connected with the scanning line G3 and the signal line S2. The sub-pixel PB21 is electrically connected with the scanning line G1 and the signal line S3. The sub-pixel PW21 is electrically connected with the scanning line G2 and the signal line S4. In the example illustrated, the signal line S2 is shared by the sub-pixel PW11 constituting the main pixel PX11 and the sub-pixel PR21 constituting the main pixel PX21. In addition, the signal line S3 is shared by the sub-pixel PG11 constituting the main pixel PX11 and the sub-pixel PB21 constituting the main pixel PX21.

Of the pixel lines composed of the sub-pixels arranged in the second direction D2, odd-numbered pixel lines are constituted similarly to the first pixel line, and even-numbered pixel lines are constituted similarly to the second pixel line. In one frame period shown in the figure, positive-polarity video signals (+) are supplied to the signal lines S1, S3, . . . and negative-polarity video signals (−) are supplied to the signal lines S2, S4, . . . . For this reason, the positive-polarity video signals (+) are written to the sub-pixels of the odd-numbered pixel lines and the negative-polarity video signals (−) are written to the sub-pixels of the even-numbered pixel lines.

It should be noted that processing of averaging the video signals is executed between the paired main pixels, in the configuration shown in the figure. For example, the signal processor SP shown in FIG. 3 executes averaging based on the video signal G11 which should be written to the green sub-pixel PG11 in the main pixel PX11 and the video signal G21 which should be written to the green sub-pixel in the main pixel PX21 (but not included in the actual main pixel PX21), and produces a corrected video signal. As the method of producing the corrected video signal for the averaging, calculating the signal as an arithmetic mean by multiplying the video signals G11 and G21 by a predetermined coefficient, calculating the signal as a geometric mean of the video signals C11 and G21 and the other methods, can be applied. The corrected video signal thus produced is supplied to the signal line S3 and written to the sub-pixel PG11 in the horizontal scanning period in which the scanning line G2 is selected. Similarly to this, the signal processor SP executes averaging based on the video signal R11 which should be written to the red sub-pixel in the main pixel PX11 (but not included in the actual main pixel PX11) and the video signal R21 which should be written to the red sub-pixel PR21 in the main pixel PX21, and writes the produced corrected video signal to the sub-pixel PR21.

The pixel layout illustrated in (B) is different from the pixel layout illustrated in (A) with respect to the sub-pixels included in each of the main pixels. That is, the main pixel PX11 includes the sub-pixels PR11, PG11 and PW11. The main pixel PX21 includes the sub-pixels PB21, PR21 and PG21. The main pixels PX12 and PX13 are also constituted similarly to the main pixel PX11, and the main pixels PX22 and PX23 are also constituted similarly to the main pixel PX21. In the example illustrated, the white sub-pixel PW11 and the blue sub-pixel PB21 are shared in the unit pixel composed of the main pixels PX11 and PX21.

In the main pixel PX11, the sub-pixel PR11 is electrically connected with the scanning line G1 and the signal line S1. The sub-pixel PG11 is electrically connected with the scanning line G2 and the signal line S2. The sub-pixel PW11 is electrically connected with the scanning line G2 and the signal line S3.

In the main pixel PX21, the sub-pixel PB21 is electrically connected with the scanning line G3 and the signal line S2. The sub-pixel PR21 is electrically connected with the scanning line G1 and the signal line S3. The sub-pixel PG21 is electrically connected with the scanning line G2 and the signal line S4. In the example illustrated, the signal line S2 is shared by the sub-pixel PG11 constituting the main pixel PX11 and the sub-pixel PB21 constituting the main pixel PX21. The signal line S3 is shared by the sub-pixel PW11 constituting the main pixel PX11 and the sub-pixel PR21 constituting the main pixel PX21.

In the configuration shown in the figure, the processing of averaging the white and blue video signals is executed between the paired main pixels PX11 and PX21.

The pixel layout illustrated in (C) is different from the pixel layout illustrated in (A) with respect to the sub-pixels included in each of the main pixels. That is, the main pixel PX11 includes the sub-pixels PW11, PG11 and PR11. The main pixel PX21 includes the sub-pixels PB21, PW21 and PG21. The main pixels PX12 and PX13 are also constituted similarly to the main pixel PX11, and the main pixels PX22 and PX23 are also constituted similarly to the main pixel PX21. In the example illustrated, the red sub-pixel PR11 and the blue sub-pixel PB21 are shared in the unit pixel composed of the main pixels PX11 and PX21.

In the main pixel PX11, the sub-pixel PW11 is electrically connected with the scanning line G1 and the signal line S1. The sub-pixel PG11 is electrically connected with the scanning line G2 and the signal line S2. The sub-pixel PR11 is electrically connected with the scanning line G2 and the signal line S3.

In the main pixel PX21, the sub-pixel PB21 is electrically connected with the scanning line G3 and the signal line S2. The sub-pixel PW21 is electrically connected with the scanning line G1 and the signal line S3. The sub-pixel PG21 is electrically connected with the scanning line G2 and the signal line S4. In the example illustrated, the signal line S2 is shared by the sub-pixel PG11 constituting the main pixel PX11 and the sub-pixel PB21 constituting the main pixel PX21. The signal line S3 is shared by the sub-pixel PR11 constituting the main pixel PX11 and the sub-pixel PW21 constituting the main pixel PX21.

In the configuration shown in the figure, the processing of averaging the red and blue video signals is executed between the paired main pixels PX11 and PX21.

In each of the configuration examples illustrated in (A) to (C), too, the same advantages as those of the above-described configuration examples can be obtained.

Figure 8:
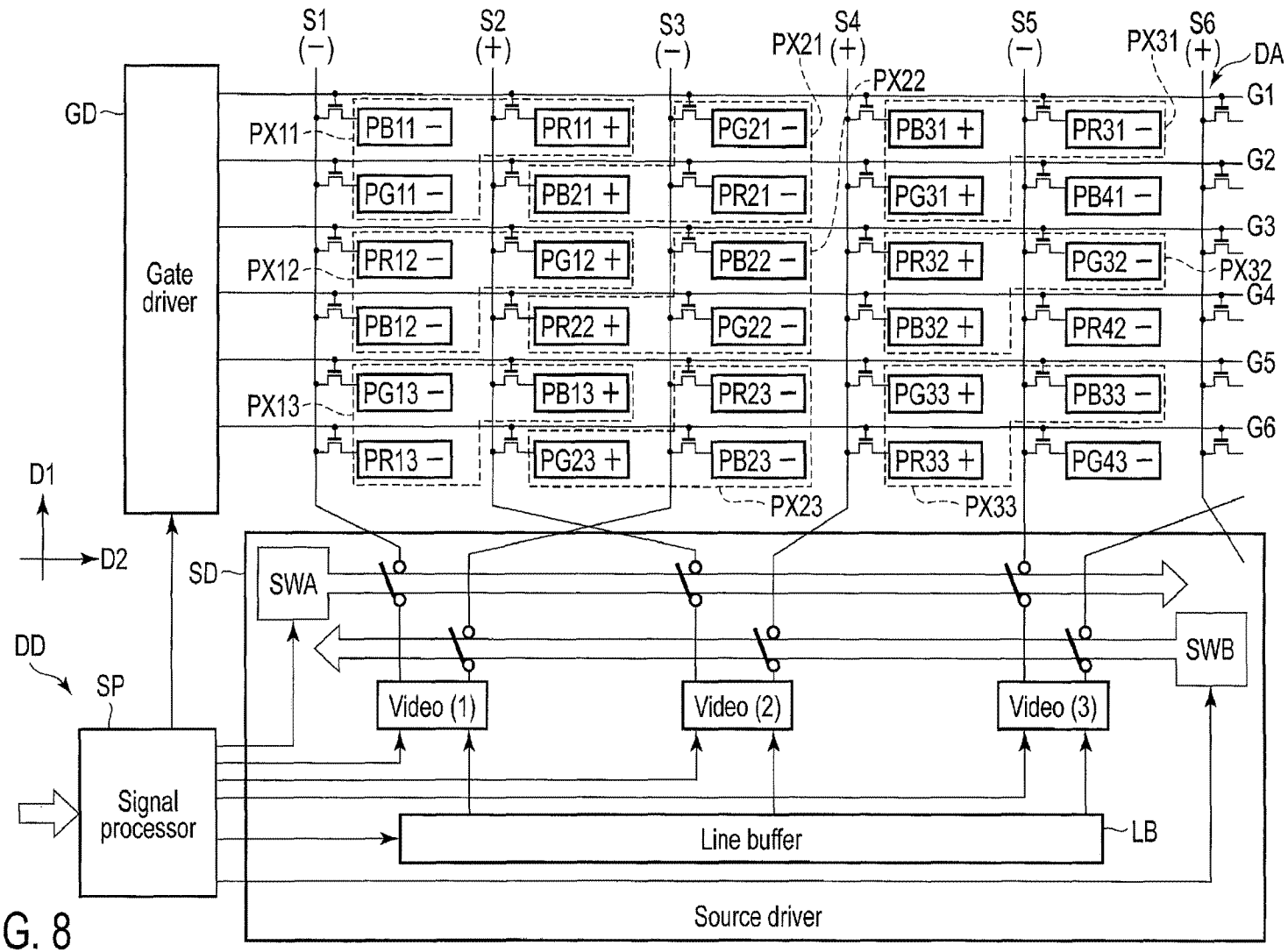
FIG. 8 is a diagram schematically showing an example of another pixel layout in the display area, and a configuration for writing the video signals to the respective pixels.

FIG. 8 is a diagram schematically showing an example of another pixel layout in the display area, and a configuration for writing the video signals to the respective pixels.

The example shown in FIG. 8 is different from the example shown in FIG. 3 with respect to the connection between the scanning lines and the signal lines in the respective sub-pixels. That is, in the main pixel PX11, the sub-pixel PB11 is electrically connected with the scanning line G1 and the signal line S1. The sub-pixel PG11 is electrically connected with the scanning line G2 and the signal line S1. The sub-pixel PR11 is electrically connected with the scanning line G1 and the signal line S2. In the main pixel PX21, the sub-pixel PB21 is electrically connected with the scanning line G2 and the signal line S2. The sub-pixel PG21 is electrically connected with the scanning line G1 and the signal line S3. The sub-pixel PR21 is electrically connected with the scanning line G2 and the signal line S3. In the main pixel PX31, the sub-pixel PB31 is electrically connected with the scanning line G1 and the signal line S4. The sub-pixel PG31 is electrically connected with the scanning line G2 and the signal line S4. The sub-pixel PR31 is electrically connected with the scanning line G1 and the signal line S5. The main pixels PX12 and PX13 are constituted similarly to the main pixel PX11, the main pixels PX22 and PX23 are constituted similarly to the main pixel PX21, and the main pixels PX32 and PX33 are constituted similarly to the main pixel PX31.

When the two main pixels PX11 and PX21 arranged in the second direction D2 are noticed, the signal line S1 is shared by the sub-pixels PB11 and PG11 constituting the main pixel PX11. In addition, the signal line S2 is shared by the sub-pixel PR11 constituting the main pixel PX11 and the sub-pixel PB21 constituting the main pixel PX21. The signal line S3 is shared by the sub-pixels PG21 and PR21 constituting the main pixel PX21.

The display driver DD is constituted similarly to that in the example shown in FIG. 3. The signal processor SP outputs some of the video signals to the output terminals Video (1) to Video (3) while outputting the other video signals to the line buffer LB. The line buffer LB temporarily stores the video signals input from the signal processor SP. For example, the signal processor SP produces video signals for one pixel line and outputs the video signals for a half pixel line to the output terminals Video (1) to Video (3) while outputting the video signals for a remaining half pixel line to the line buffer LB and temporarily storing the video signals in the line buffer LB. For this reason, the line buffer LB may have a storage capacity to store video signals for at least a half pixel line. Outputting the video signals will be explained later.

In this configuration, the polarities of the video signals output to each of the signal lines S1 to S6, in one frame period, are not varied, and the polarities of the video signals output to adjacent signal lines are opposite. In the example illustrated, the polarities of the video signals output to the odd-numbered signal lines S1, S3 and S5 are negative (−) and the polarities of the video signals output to the even-numbered signal lines S2, S4 and S6 are positive (+), in a certain frame period. In one frame period subsequent to the frame period shown in the figure, the polarities of the video signals output to the odd-numbered signal lines are positive (+), and the polarities of the video signals output to the even-numbered signal lines are negative (−). In other words, the column-inversion drive scheme is applied to the present configuration.

In addition, in the frame period shown in the figure, the polarities of the video signals written to the sub-pixels arranged in the first direction D1 are the same as each other, and the polarities of the video signals written to the sub-pixels arranged in the second directions D2 are opposite to each other.

FIG. 9 is a table for explanation of an example of a method of writing the video signals to the liquid crystal display panel PNL of the pixel layout shown in FIG. 8.

In the horizontal scanning period in which the scanning line G1 is selected, the signal processor SP produces the video signals (R11, G11, B11, R21, G21, B21, R31, G31, B31, . . . ) corresponding to the main pixels PX11, PX21 and PX31 as the input data and supplies the video signals to the source driver SD. At this time, the signal processor SP supplies the video signals (R11, B11, G21, R31, B31, . . . ) to the liquid crystal display panel PNL while supplying the video signals (G11, R21, B21, G31, . . . ) to the line buffer LB. The video signals are thereby written to the sub-pixels PR11, PB11, PG21, PR31 and PB31, respectively. The line buffer LB temporarily stores the video signals (G11, R21, B21, G31, . . . )

In the horizontal scanning period in which the scanning line G2 is selected, the source driver SD supplies the video signals (G11, R21, B21, G31, . . . ) stored in the line buffer LB, to the liquid crystal display panel PNL. The video signals are thereby written to the sub-pixels PG11, PR21, PB21 and PG31, respectively.

In the horizontal scanning period in which the scanning line G3 is selected, the signal processor SP produces the video signals (R12, G12, B12, R22, G22, B22, R32, G32, B32, . . . ) corresponding to the main pixels PX12, PX22 and PX32 as the input data and supplies the video signals to the source driver SD. At this time, the signal processor SP supplies the video signals (R12, G12, B22, R32, G32, . . . ) to the liquid crystal display panel PNL while supplying the video signals (B12, R22, G22, B32, . . . ) to the line buffer LB. The video signals are thereby written to the sub-pixels PR12, PG12, PB22, PR32 and PG32, respectively. The line buffer LB temporarily stores the video signals (B12, R22, G22, B32, . . . ).

In the horizontal scanning period in which the scanning line G4 is selected, the source driver SD supplies the video signals (B12, R22, G22, B32, . . . ) stored in the line buffer LB, to the liquid crystal display panel PNL. The video signals are thereby written to the sub-pixels PB12, PR22, PG22 and PB32, respectively.

In the horizontal scanning period in which the scanning line G5 is selected, the signal processor SP produces the video signals (R13, G13, B13, R23, G23, B23, R33, G33, B33, . . . ) corresponding to the main pixels PX13, PX23 and PX33 as the input data and supplies the video signals to the source driver SD. At this time, the signal processor SP supplies the video signals (G13, B13, R23, G33, B33, . . . ) to the liquid crystal display panel PNL while supplying the video signals (R13, G23, B23, R33, . . . ) to the line buffer LB. The video signals are thereby written to the sub-pixels PG13, PB13, PR23, PG33 and PB33, respectively. The line buffer LB temporarily stores the video signals (R13, G23, B23, R33, . . . ).

In the horizontal scanning period in which the scanning line G6 is selected, the source driver SD supplies the video signals (R13, G23, B23, R33, . . . ) stored in the line buffer LB, to the liquid crystal display panel PNL. The video signals are thereby written to the sub-pixels PR13, PG23, PR23 and PR33, respectively.

Figure 10:
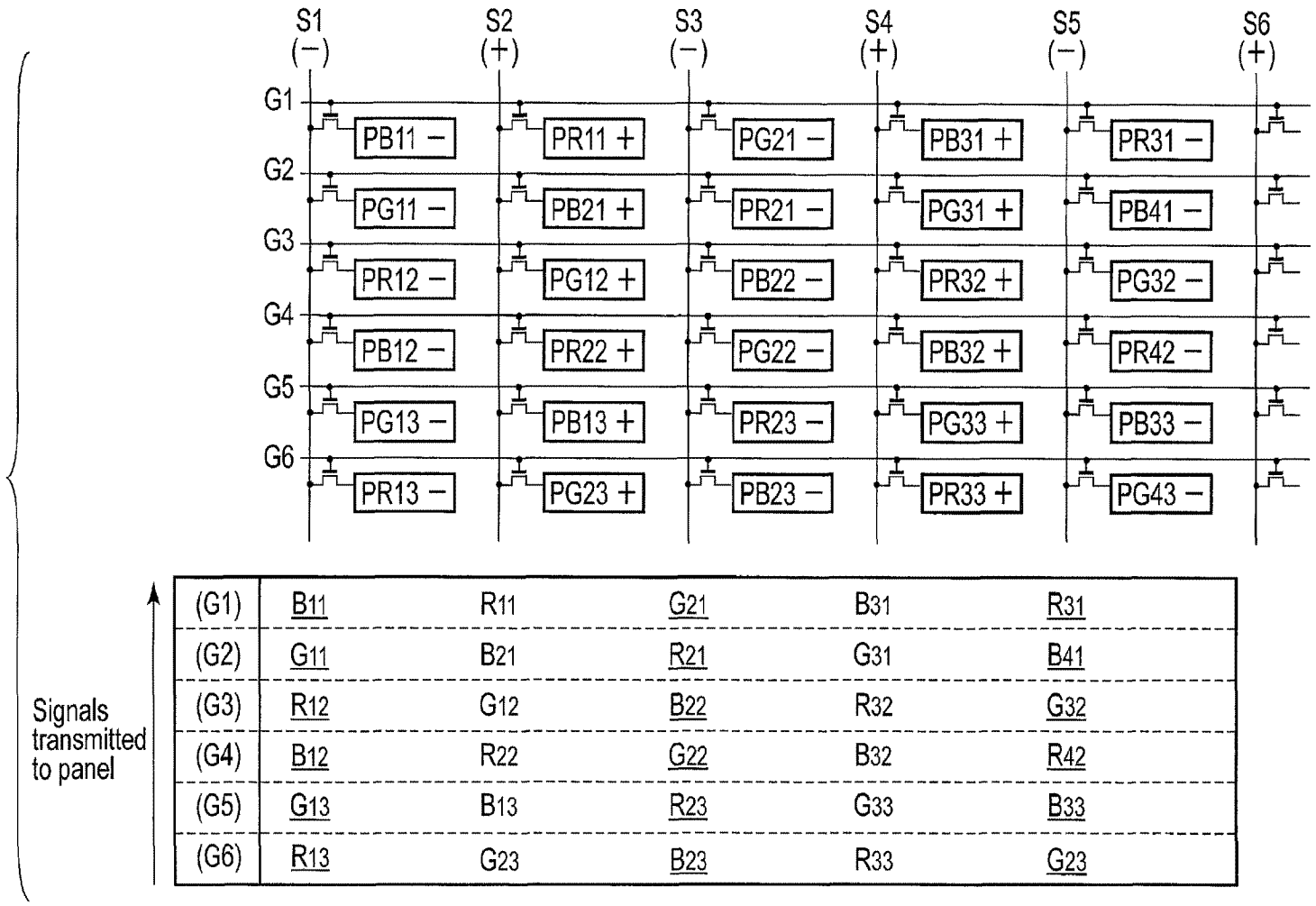
FIG. 10 is an illustration showing a summary of the polarities of the video signals output to each signal line by the writing method explained with reference to FIG. 9.

FIG. 10 is an illustration showing a summary of the polarities of the video signals output to each signal line by the writing method explained with reference to FIG. 9.

In the horizontal scanning period in which the scanning line G1 is selected, the video signal B11 is output to the signal line S1, the video signal R11 is output to the signal line S2, the video signal G21 is output to the signal line S3, the video signal B31 is output to the signal line S4, and the video signal R31 is output to the signal line S5.

In the horizontal scanning period in which the scanning line G2 is selected, the video signal G11 is output to the signal line S1, the video signal B21 is output to the signal line S2, the video signal R21 is output to the signal line S3, the video signal G31 is output to the signal line S4, and the video signal B41 is output to the signal line S5.

In the horizontal scanning period in which the scanning line G3 is selected, the video signal R12 is output to the signal line S1, the video signal G12 is output to the signal line S2, the video signal B22 is output to the signal line S3, the video signal R32 is output to the signal line S4, and the video signal G32 is output to the signal line S5.

In the horizontal scanning period in which the scanning line G4 is selected, the video signal B12 is output to the signal line S1, the video signal R22 is output to the signal line S2, the video signal G22 is output to the signal line S3, the video signal B32 is output to the signal line S4, and the video signal R41 is output to the signal line S5.

In the horizontal scanning period in which the scanning line G5 is selected, the video signal G13 is output to the signal line S1, the video signal B13 is output to the signal line S2, the video signal R23 is output to the signal line S3, the video signal G33 is output to the signal line S4, and the video signal B33 is output to the signal line S5.

In the horizontal scanning period in which the scanning line G6 is selected, the video signal R13 is output to the signal line S1, the video signal G23 is output to the signal line S2, the video signal B23 is output to the signal line S3, the video signal R33 is output to the signal line S4, and the video signal G43 is output to the signal line S5.

When the polarities of the video signals output to the signal lines S1, S3 and S5 are noticed, all the polarities are the same and negative (−) in one frame period, in the example illustrated. When the polarities of the video signals output to the signal lines S2, S4 and S6 are noticed, all the polarities are the same and positive (+) in one frame period, in the example illustrated.

When the main pixel PX11 is noticed, the video signals B11 and R11 are written to the sub-pixels PB11 and PR11, respectively, in the horizontal scanning period in which the scanning line G1 is selected, and the video signal G11 is written to the sub-pixel PG11 in the horizontal scanning period in which the scanning line G2 is selected, as shown in the figure. When the main pixel PX21 is noticed, the video signal G21 is written to the sub-pixel PG21 in the horizontal scanning period in which the scanning line G1 is selected, and the video signals B21 and R21 are written to the sub-pixels PB21 and PR21, respectively, in the horizontal scanning period in which the scanning line G2 is selected. In other words, the horizontal scanning periods for at least two pixel lines are required to write the video signals to all the sub-pixels constituting each main pixel.

Figure 11:
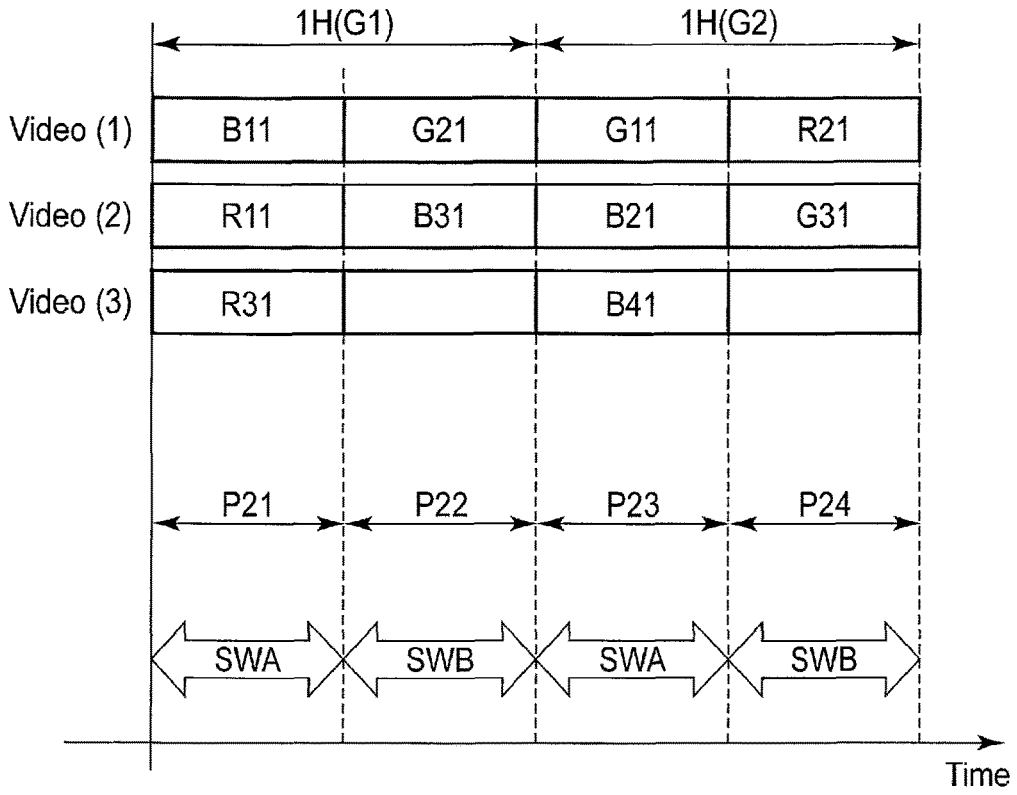
FIG. 11 is an illustration showing an example of timing of writing the video signals to the respective sub-pixels of the pixel layout shown in FIG. 8.

FIG. 11 is an illustration showing an example of timing of writing the video signals to the respective sub-pixels of the pixel layout shown in FIG. 8.

The horizontal scanning period 1H(G1) in which the scanning line G1 is selected includes a first period P21 and a second period P22 subsequent to the first period P21. The horizontal scanning period 1H(G2) in which the scanning line G2 is selected includes a third period P23 and a fourth period P24 subsequent to the third period P23. The first period P21 and the third period P23 are periods in which the switch SWA is conductive and the switch SWB is non-conductive. The second period P22 and the fourth period P24 are periods in which the switch SWB is conductive and the switch SWA is non-conductive.

In the first period P21, the output terminal Video (1) is electrically connected with the signal line S1, the output terminal Video (2) is electrically connected with the signal line S2, and the output terminal Video (3) is electrically connected with the signal line S5. The video signal B11 output from the output terminal Video (1) is written to the sub-pixel PB11 via the signal line S1. The video signal R11 output from the output terminal Video (2) is written to the sub-pixel PR11 via the signal line S2. The video signal R31 output from the output terminal Video (3) is written to the sub-pixel PR31 via the signal line S5.

In the second period P22, the output terminal Video (1) is electrically connected with the signal line S3, and the output terminal Video (2) is electrically connected with the signal line S4. The video signal G21 output from the output terminal Video (1) is written to the sub-pixel PG21 via the signal line S3. The video signal B31 output from the output terminal Video (2) is written to the sub-pixel PB31 via the signal line S4.

In the third period P23, the video signal G11 output from the output terminal Video (1) is written to the sub-pixel PG11 via the signal line S1. The video signal B21 output from the output terminal Video (2) is written to the sub-pixel PB21 via the signal line S2. The video signal B41 output from the output terminal Video (3) is written to the sub-pixel PB41 via the signal line S5.

In the fourth period P24, the video signal R21 output from the output terminal Video (1) is written to the sub-pixel PR21 via the signal line S3. The video signal G31 output from the output terminal Video (2) is written to the sub-pixel PG31 via the signal line S4.

In this configuration example, too, one and a half signal lines are allocated to each main pixel and, even if the number of the main pixels which should be disposed in the display area is increased, increase in the number of signal lines can be suppressed and the energy consumption can be reduced. In addition, since the column-inversion drive scheme is applied, the energy consumption can be reduced in comparison with the application of the line-inversion drive scheme.

Figure 12:
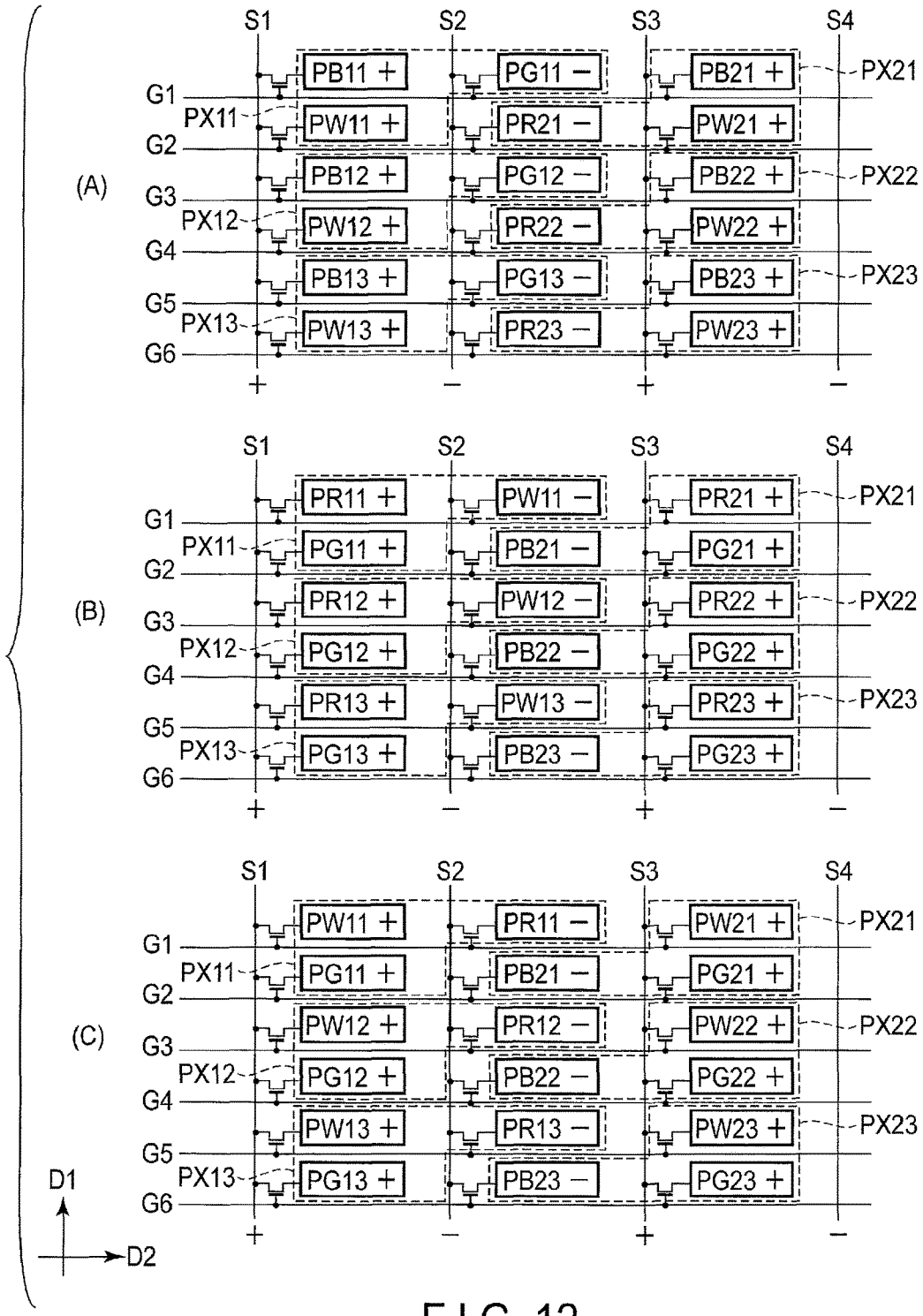
FIG. 12 is an illustration schematically showing a relationship between yet another pixel layout in the display area, and the polarities of the video signals written to the respective pixels.

FIG. 12 is an illustration schematically showing a relationship between yet another pixel layout in the display area, and the polarities of the video signals written to the respective pixels.

In the pixel layout illustrated in (A), the main pixel PX11 includes the sub-pixels PB11, PW11 and PG11. The main pixel PX21 includes the sub-pixels PR21, PB21 and PW21. The main pixels PX12 and PX13 are also constituted similarly to the main pixel PX11, and the main pixels PX22 and PX23 are also constituted similarly to the main pixel PX21. Two main pixels arranged in the second direction D2 function as a pair of unit pixels and share sub-pixels of colors removed from the respective main pixels. In the example illustrated, the green sub-pixel PG11 and the red sub-pixel PR21 are shared in the unit pixel composed of the main pixels PX11 and PX21.

In the main pixel PX11, the sub-pixel PB11 is electrically connected with the scanning line G1 and the signal line S1. The sub-pixel PW11 is electrically connected with the scanning line G2 and the signal line S1. The sub-pixel PG11 is electrically connected with the scanning line G1 and the signal line S2.

In the main pixel PX21, the sub-pixel PR21 is electrically connected with the scanning line G2 and the signal line S2. The sub-pixel PB21 is electrically connected with the scanning line G1 and the signal line S3. The sub-pixel PW21 is electrically connected with the scanning line G2 and the signal line S3. In the example illustrated, the signal line S1 is shared by the sub-pixels PB11 and PW11 constituting the main pixel PX11. In addition, the signal line S2 is shared by the sub-pixel PG11 constituting the main pixel PX11 and the sub-pixel PR21 constituting the main pixel PX21. In addition, the signal line S3 is shared by the sub-pixels PB21 and PW21 constituting the main pixel PX21.

Of the pixel lines composed of the sub-pixels arranged in the second direction D2, odd-numbered pixel lines are constituted similarly to the first pixel line, and even-numbered pixel lines are constituted similarly to the second pixel line. In one frame period shown in the figure, positive-polarity video signals (+) are supplied to the signal lines S1, S3, . . . and negative-polarity video signals (−) are supplied to the signal lines S2, S4, . . . . In the configuration shown in the figure, the processing of averaging the red and green video signals is executed between the paired main pixels PX11 and PX21.

In the pixel layout illustrated in (B), the main pixel PX11 includes the sub-pixels PR11, PG11 and PW11. The main pixel PX21 includes the sub-pixels PB21, PR21 and PG21. The main pixels PX12 and PX13 are also constituted similarly to the main pixel PX11, and the main pixels PX22 and PX23 are also constituted similarly to the main pixel PX21. In the example illustrated, the white sub-pixel PW11 and the blue sub-pixel PB21 are shared in the unit pixel composed of the main pixels PX11 and PX21.

In the main pixel PX11, the sub-pixel PR11 is electrically connected with the scanning line G1 and the signal line S1. The sub-pixel PG11 is electrically connected with the scanning line G2 and the signal line S1. The sub-pixel PW11 is electrically connected with the scanning line G1 and the signal line S2.

In the main pixel PX21, the sub-pixel PB21 is electrically connected with the scanning line G2 and the signal line S2. The sub-pixel PR21 is electrically connected with the scanning line G1 and the signal line S3. The sub-pixel PG21 is electrically connected with the scanning line G2 and the signal line S3. In the example illustrated, the signal line S1 is shared by the sub-pixels PR11 and PG11 constituting the main pixel PX11. In addition, the signal line S2 is shared by the sub-pixel PW11 constituting the main pixel PX11 and the sub-pixel PB21 constituting the main pixel PX21. The signal line S3 is shared by the sub-pixels PR21 and PG21 constituting the main pixel PX21.

In the configuration shown in the figure, the processing of averaging the white and blue video signals is executed between the paired main pixels PX11 and PX21.

In the pixel layout illustrated in (C), the main pixel PX11 includes the sub-pixels PW11, PG11 and PR11. The main pixel PX21 includes the sub-pixels PB21, PW21 and PG21. The main pixels PX12 and PX13 are also constituted similarly to the main pixel PX11, and the main pixels PX22 and PX23 are also constituted similarly to the main pixel PX21. In the example illustrated, the red sub-pixel PR11 and the blue sub-pixel PB21 are shared in the unit pixel composed of the main pixels PX11 and PX21.

In the main pixel PX11, the sub-pixel PW11 is electrically connected with the scanning line G1 and the signal line S1. The sub-pixel PG11 is electrically connected with the scanning line G2 and the signal line S1. The sub-pixel PR11 is electrically connected with the scanning line G1 and the signal line S2.

In the main pixel PX21, the sub-pixel PB21 is electrically connected with the scanning line G2 and the signal line S2. The sub-pixel PW21 is electrically connected with the scanning line G1 and the signal line S3. The sub-pixel PG21 is electrically connected with the scanning line G2 and the signal line S3. In the example illustrated, the signal line S1 is shared by the sub-pixels PW11 and PG11 constituting the main pixel PX11. In addition, the signal line S2 is shared by the sub-pixel PR11 constituting the main pixel PX11 and the sub-pixel PB21 constituting the main pixel PX21. The signal line S3 is shared by the sub-pixels PW21 and PG21 constituting the main pixel PX21.

In the configuration shown in the figure, the processing of averaging the red and blue video signals is executed between the paired main pixels PX11 and PX21.

In each of the configuration examples illustrated in (A) to (C), too, the same advantages as those of the above-described configuration examples can be obtained.

Next, yet another configuration example will be explained. In the configuration example explained below, the first direction D1 and the second direction D2 are different from those in the above-explained configuration examples, the first direction D1 corresponds to a direction in which the signal lines S1 to S6 are arranged and the second direction D2 corresponds to a direction in which the scanning lines G1 to G5 are arranged. In addition, each of the sub-pixels is in a longitudinally elongated shape extending in the second direction D2.

Figure 13:
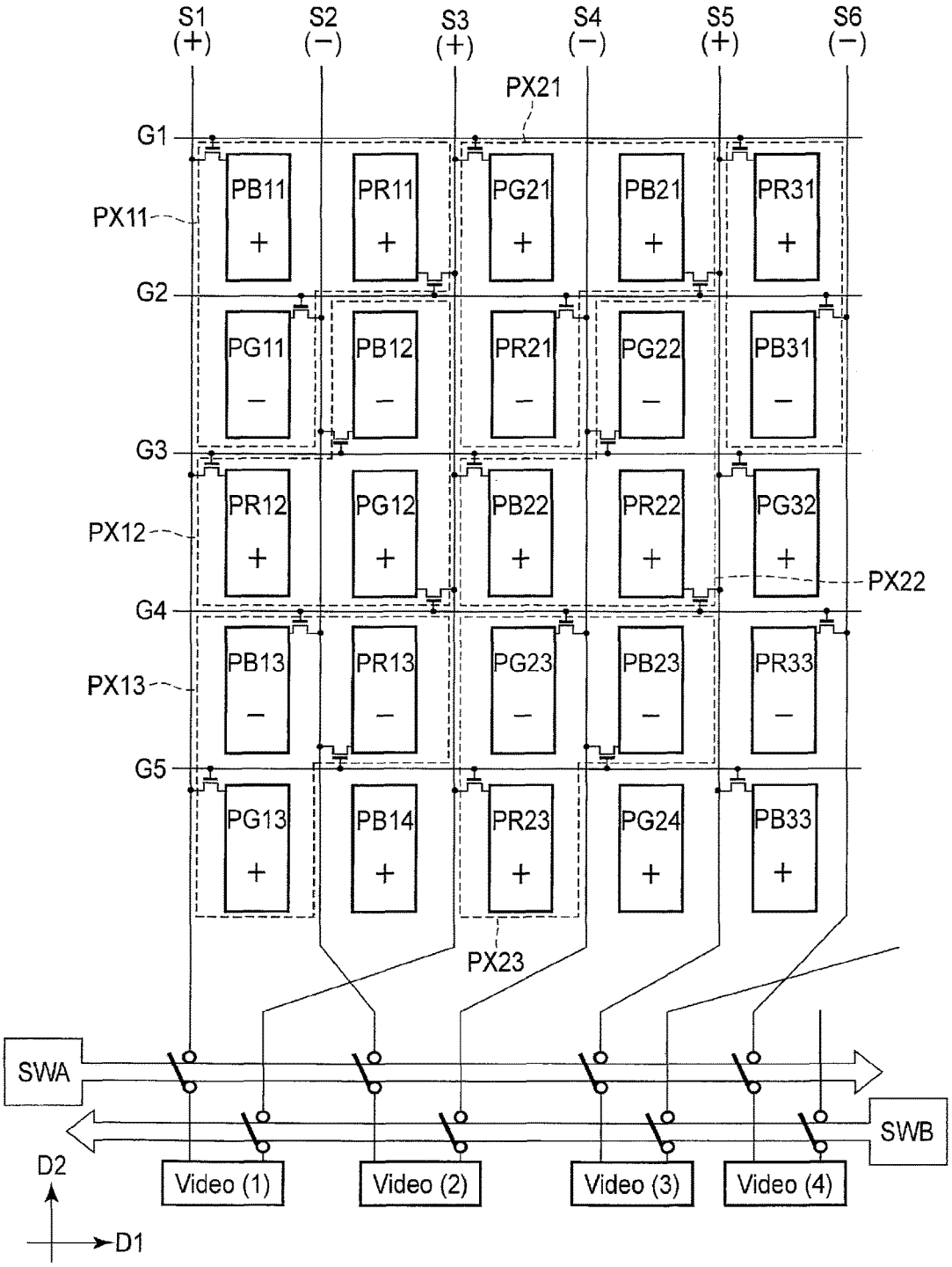
FIG. 13 is an illustration schematically showing a relationship between yet another pixel layout in the display area, and the polarities of the video signals written to the respective pixels.

FIG. 13 is a diagram schematically showing an example of yet another pixel layout in the display area, and a configuration for writing the video signals to the respective pixels.

The main pixel PX11 includes a sub-pixel (first sub-pixel) PB11, a sub-pixel (second sub-pixel) PR11 and a sub-pixel (third sub-pixel) PG11. The sub-pixel PR11 and the sub-pixel PB11 are arranged in the first direction D1. The sub-pixel PG11 and the sub-pixel PB11 are arranged in the second direction D2. The sub-pixel PB11 is electrically connected with the scanning line G1 and the signal line S1. The sub-pixel PR11 is electrically connected with the scanning line G2 and the signal line S3. The sub-pixel PG11 is electrically connected with the scanning line G2 and the signal line S2.

The main pixel PX12 includes a sub-pixel (fourth sub-pixel) PB12, a sub-pixel (fifth sub-pixel) PR12 and a sub-pixel (sixth sub-pixel) PG12. The sub-pixel PB12 and the sub-pixel PG11 are arranged in the first direction D1. The sub-pixel PR12 and the sub-pixel PG11 are arranged in the second direction D2. The sub-pixel PG12 and the sub-pixel PR12 are arranged in the first direction D1. The sub-pixel PB12 is electrically connected with the scanning line G3 and the signal line S2. The sub-pixel PR12 is electrically connected with the scanning line G3 and the signal line S1. The sub-pixel PG12 is electrically connected with the scanning line G4 and the signal line S3.

The main pixel PX13 includes the sub-pixels PB13, PR13 and PG13. The sub-pixel PR13 and the sub-pixel PB13 are arranged in the first direction D1. The sub-pixel PG13 and the sub-pixel PB13 are arranged in the second direction D2. The sub-pixel PB13 is electrically connected with the scanning line G4 and the signal line S2. The sub-pixel PR13 is electrically connected with the scanning line G5 and the signal line S2. The sub-pixel PG13 is electrically connected with the scanning line G5 and the signal line S1.

The main pixels PX21, PX22 and PX23 are constituted similarly to the main pixels PX11, PX12 and PX13, respectively.

When the two main pixels PX11 and PX12 arranged in the second direction D2 are noticed, in the example illustrated, the signal line S1 is shared by the sub-pixel PB11 constituting the main pixel PX11 and the sub-pixel PR12 constituting the main pixel PX12. In addition, the signal line S2 is shared by the sub-pixel PG11 constituting the main pixel PX11 and the sub-pixel PB12 constituting the main pixel PX12. The signal line S3 is shared by the sub-pixel PR11 constituting the main pixel PX11 and the sub-pixel PG12 constituting the main pixel PX12.

The output terminal Video (1) is electrically connected with the signal lines S1 and S3, the output terminal Video (2) is electrically connected with the signal lines S2 and S4, the output terminal Video (3) is electrically connected with the signal line S5, and the output terminal Video (4) is electrically connected with the signal line S6. The switch SWA is interposed between the signal line S1 and the output terminal Video (1), between the signal line S2 and the output terminal Video (2), between the signal line S5 and the output terminal Video (3), and between the signal line S6 and the output terminal Video (4). The switch SWB is interposed between the signal line S3 and the output terminal Video (1), and between the signal line S4 and the output terminal Video (2).

The column-inversion drive scheme is applied to the present configuration and, in the example illustrated, the polarities of the video signals output to the odd-numbered signal lines S1, S3 and S5 are positive (+) and the polarities of the video signals output to the even-numbered signal lines S2, S4 and S6 are negative (−), in a certain frame period. In contrast, in the present configuration, the same polarity distribution as that of the line-inversion drive scheme can be obtained and, in the frame period shown in the figure, the polarities of the video signals written to the sub-pixels of the odd-numbered pixel lines are positive (+) and the polarities of the video signals written to the sub-pixels of the even-numbered pixel lines are negative (−).

In this configuration example, two signal lines are allocated to each main pixel and, even if the number of the main pixels which should be disposed in the display area is increased, increase in the number of signal lines can be suppressed and the energy consumption can be reduced. In addition, since the column-inversion drive scheme is applied, the energy consumption can be reduced in comparison with the application of the line-inversion drive scheme.

Figure 14:
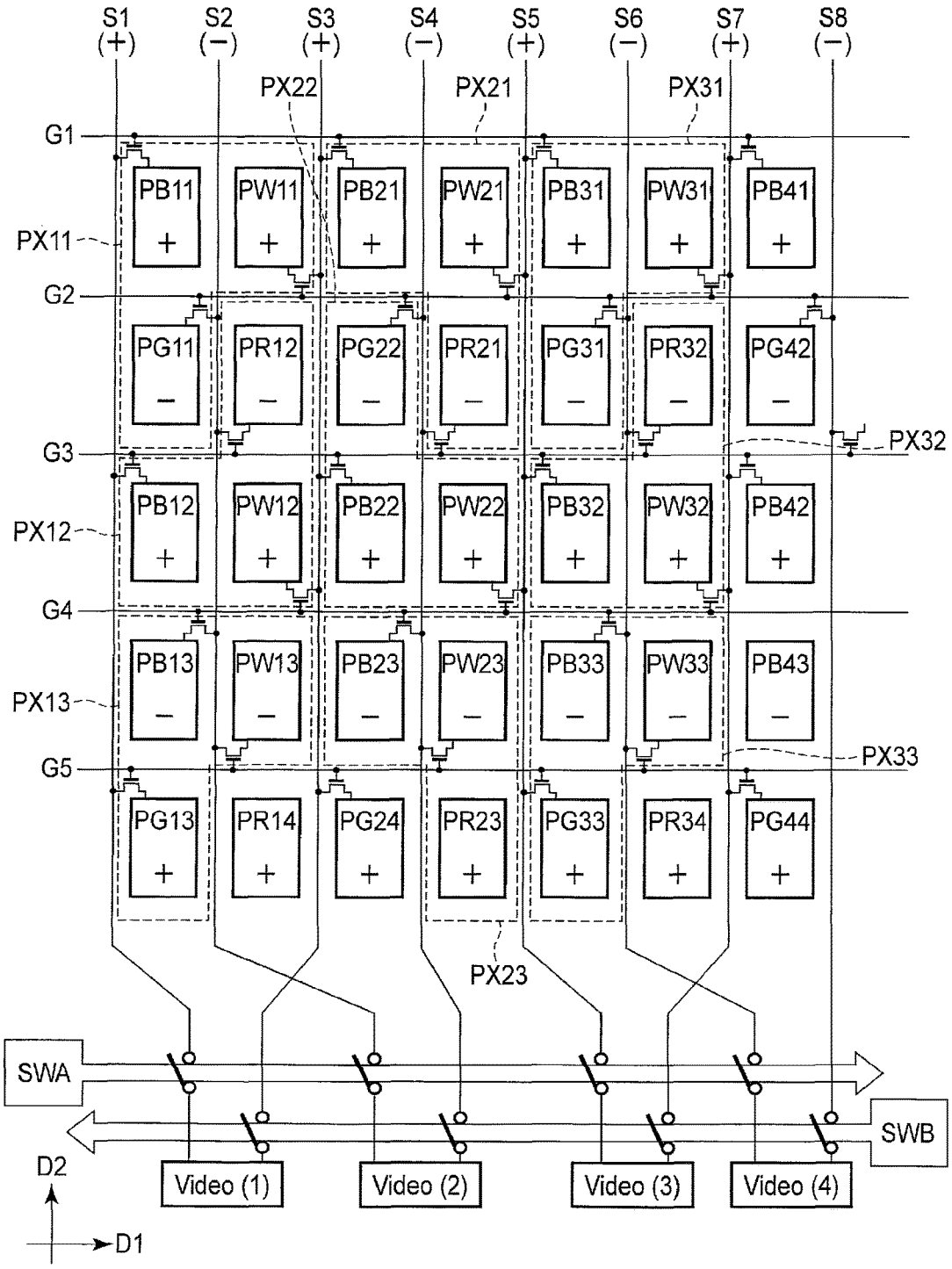
FIG. 14 is an illustration schematically showing a relationship between yet another pixel layout in the display area, and polarities of video signals written to the respective pixels.

FIG. 14 is a diagram schematically showing an example of yet another pixel layout in the display area, and a configuration for writing the video signals to the respective pixels.

The main pixel PX11 includes the sub-pixels PB11, PW11 and PG11. The sub-pixel PW11 and the sub-pixel PB11 are arranged in the first direction D1. The sub-pixel PG11 and the sub-pixel PB11 are arranged in the second direction D2. The sub-pixel PB11 is electrically connected with the scanning line G1 and the signal line S1. The sub-pixel PW11 is electrically connected with the scanning line G2 and the signal line S3. The sub-pixel PG11 is electrically connected with the scanning line G2 and the signal line S2.

The main pixel PX12 includes the sub-pixels PR12, PB12 and PW12. The sub-pixel PR12 and the sub-pixel PG11 are arranged in the first direction D1. The sub-pixel PB12 and the sub-pixel PG11 are arranged in the second direction D2. The sub-pixel PW12 and the sub-pixel PB12 are arranged in the first direction D1. The sub-pixel PR12 is electrically connected with the scanning line G3 and the signal line S2. The sub-pixel PB12 is electrically connected with the scanning line G3 and the signal line S1. The sub-pixel PW12 is electrically connected with the scanning line G4 and the signal line S3.

The main pixel PX13 includes the sub-pixels PB13, PW13 and PG13. The sub-pixel PW13 is arranged in the first direction D1 of the sub-pixel PB13. The sub-pixel PG13 is arranged in the second direction D2 of the sub-pixel PB13. The sub-pixel PB13 is electrically connected with the scanning line G4 and the signal line S2. The sub-pixel PW13 is electrically connected with the scanning line G5 and the signal line S2. The sub-pixel PG13 is electrically connected with the scanning line G5 and the signal line S1.

The main pixels PX21 to PX23 and PX31 to PX33 are constituted similarly to the main pixels PX11 to PX13.

When the two main pixels PX11 and PX12 arranged in the second direction D2 are noticed, in the example illustrated, the signal line S1 is shared by the sub-pixel PB11 constituting the main pixel PX11 and the sub-pixel PB12 constituting the main pixel PX12. In addition, the signal line S2 is shared by the sub-pixel PG11 constituting the main pixel PX11 and the sub-pixel PR12 constituting the main pixel PX12. The signal line S3 is shared by the sub-pixel PW11 constituting the main pixel PX11 and the sub-pixel PW12 constituting the main pixel PX12.

The output terminal Video (1) is electrically connected with the signal lines S1 and S3, the output terminal Video (2) is electrically connected with the signal lines S2 and S4, the output terminal Video (3) is electrically connected with the signal lines S5 and S7, and the output terminal Video (4) is electrically connected with the signal lines S6 and S8. The switch SWA is interposed between the signal line S1 and the output terminal Video (1), between the signal line S2 and the output terminal Video (2), between the signal line S5 and the output terminal Video (3), and between the signal line S6 and the output terminal Video (4). The switch SWB is interposed between the signal line S3 and the output terminal Video (1), between the signal line S4 and the output terminal Video (2), between the signal line S7 and the output terminal Video (3), and between the signal line S8 and the output terminal Video (4).

The column-inversion drive scheme is applied to the present configuration and, in the example illustrated, the polarities of the video signals output to the odd-numbered signal lines S1, S3, S5 and S7 are positive (+) and the polarities of the video signals output to the even-numbered signal lines S2, S4, S6 and S8 are negative (−), in a certain frame period. In contrast, in the present configuration, the same polarity distribution as that of the line-inversion drive scheme can be obtained and, in the frame period shown in the figure, the polarities of the video signals written to the sub-pixels of the odd-numbered pixel lines are positive (+) and the polarities of the video signals written to the sub-pixels of the even-numbered pixel lines are negative (−).

Two main pixels arranged in the second direction D2 function as a pair of unit pixels and share sub-pixels of colors removed from the respective main pixels. In the example illustrated, the green sub-pixel PG11 and the red sub-pixel PR12 are shared in the unit pixel composed of the main pixels PX11 and PX12. In the configuration shown in the figure, the processing of averaging the red and green video signals is executed between the paired main pixels PX11 and PX21.

Figure 15:
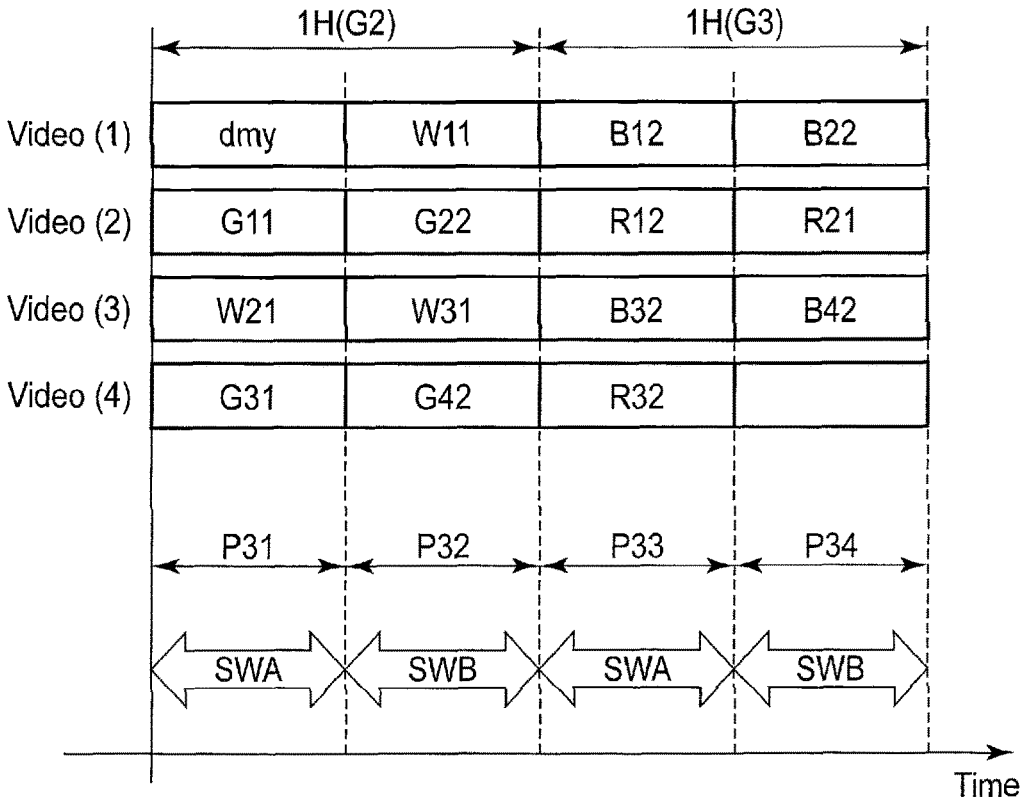
FIG. 15 is an illustration showing an example of timing of writing the video signals to the respective sub-pixels of the pixel layout shown in FIG. 14.

FIG. 15 is an illustration showing an example of timing of writing the video signals to the respective sub-pixels of the pixel layout shown in FIG. 14.

The horizontal scanning period 1H(G2) in which the scanning line G2 is selected includes a first period P31 and a second period P32 subsequent to the first period P31. The horizontal scanning period 1H(G3) in which the scanning line G3 is selected includes a third period P33 and a fourth period P34 subsequent to the third period P33.

In the first period P31, a dummy video signal dmy output from the output terminal Video (1) is output to the signal line S1. The video signal G11 output from the output terminal Video (2) is written to the sub-pixel PG11 via the signal line S2. The video signal W21 output from the output terminal Video (3) is written to the sub-pixel PW21 via the signal line S5. The video signal G31 output from the output terminal Video (4) is written to the sub-pixel PG31 via the signal line S6.

In the second period P32, the video signal W11 output from the output terminal Video (1) is written to the sub-pixel PW11 via the signal line S3. The video signal G22 output from the output terminal Video (2) is written to the sub-pixel PG22 via the signal line S4. The video signal W31 output from the output terminal Video (3) is written to the sub-pixel PW31 via the signal line S7. The video signal G42 output from the output terminal Video (4) is written to the sub-pixel PG42 via the signal line S8.

In the third period P33, the video signal B12 output from the output terminal Video (1) is written to the sub-pixel PB12 via the signal line S1. The video signal R12 output from the output terminal Video (2) is written to the sub-pixel PR12 via the signal line S2. The video signal B32 output from the output terminal Video (3) is written to the sub-pixel PB32 via the signal line S5. The video signal R32 output from the output terminal Video (4) is written to the sub-pixel PB32 via the signal line S6.

In the fourth period P34, the video signal B22 output from the output terminal Video (1) is written to the sub-pixel PG22 via the signal line S3. The video signal R21 output from the output terminal Video (2) is written to the sub-pixel PR21 via the signal line S4. The video signal B42 output from the output terminal Video (3) is written to the sub-pixel PG42 via the signal line S7.

In this configuration example, too, the same advantages as those of the configuration example shown in FIG. 13 can be obtained.

Next, an example of optimization of an alignment direction AP1 of the first alignment film AL1 and an alignment direction AP2 of the second alignment film AL2 on the reflective liquid crystal display panel PNL will be explained.

Figure 16:
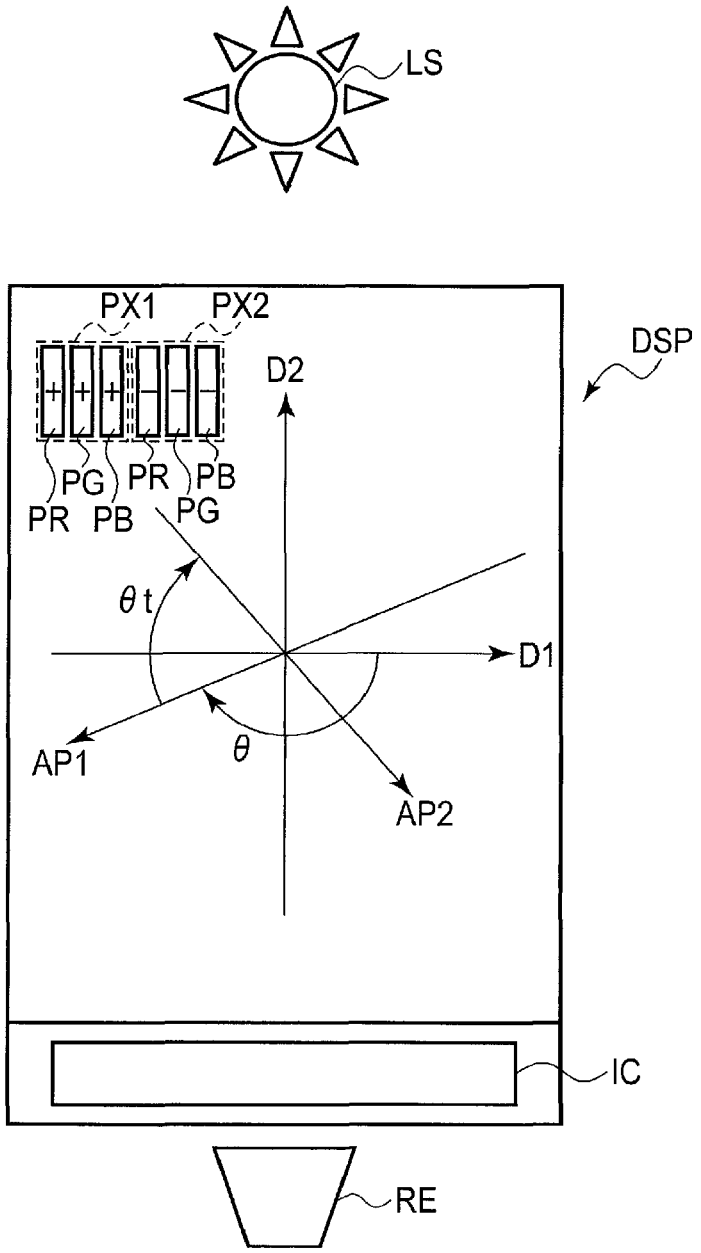
FIG. 16 is an illustration for explanation of a relationship between the alignment direction AP1 of the first alignment film AL1 and the alignment direction AP2 of the second alignment film AL2.

FIG. 16 is an illustration for explanation of a relationship between the alignment direction AP1 of the first alignment film AL1 and the alignment direction AP2 of the second alignment film AL2. A shorter-side direction of the display device DSP is referred to as a first direction D1, a longer-side direction of the display device DSP is referred to as a second direction D2, and the first direction D1 and the second direction D2 are assumed to be orthogonal to each other. A clockwise angle between the first direction D1 and the alignment direction AP1 is represented by θ and a twist angle of the liquid crystal molecules defined by the alignment direction AP1 and the alignment direction AP2 is represented by θt. The driving IC chip IC is located on the negative side in the second direction D2. It is assumed that the main pixel PX1 and the main pixel PX2 are arranged in the first direction D1 and the polarity of the main pixel PX1 is opposite to the polarity of the main pixel PX2, in the display device DSP. Each of the main pixel PX1 and the main pixel PX2 includes the sub-pixels PR, PG, and PB arranged in the first direction D1.

In the display device DSP, the following experiment was conducted. That is, the reflectivity and the contrast ratio were measured in a situation that the light source LS was fixed on a positive side in the second direction D2 shown in the figure, a light receiving portion RE was fixed on a negative side in the second direction D2 shown in the figure, and the display device DSP was rotated clockwise in the X-Y plane defined by the first direction D1 and the second direction D2. The twist angle θt was set at 70° and the angle θ corresponded to the angle of rotation set for rotation of the display device DSP. The measurement of the reflectivity and the contrast ratio was conducted within the range of the angle (or the angle of rotation) from 0 to 360°.

Figure 17:
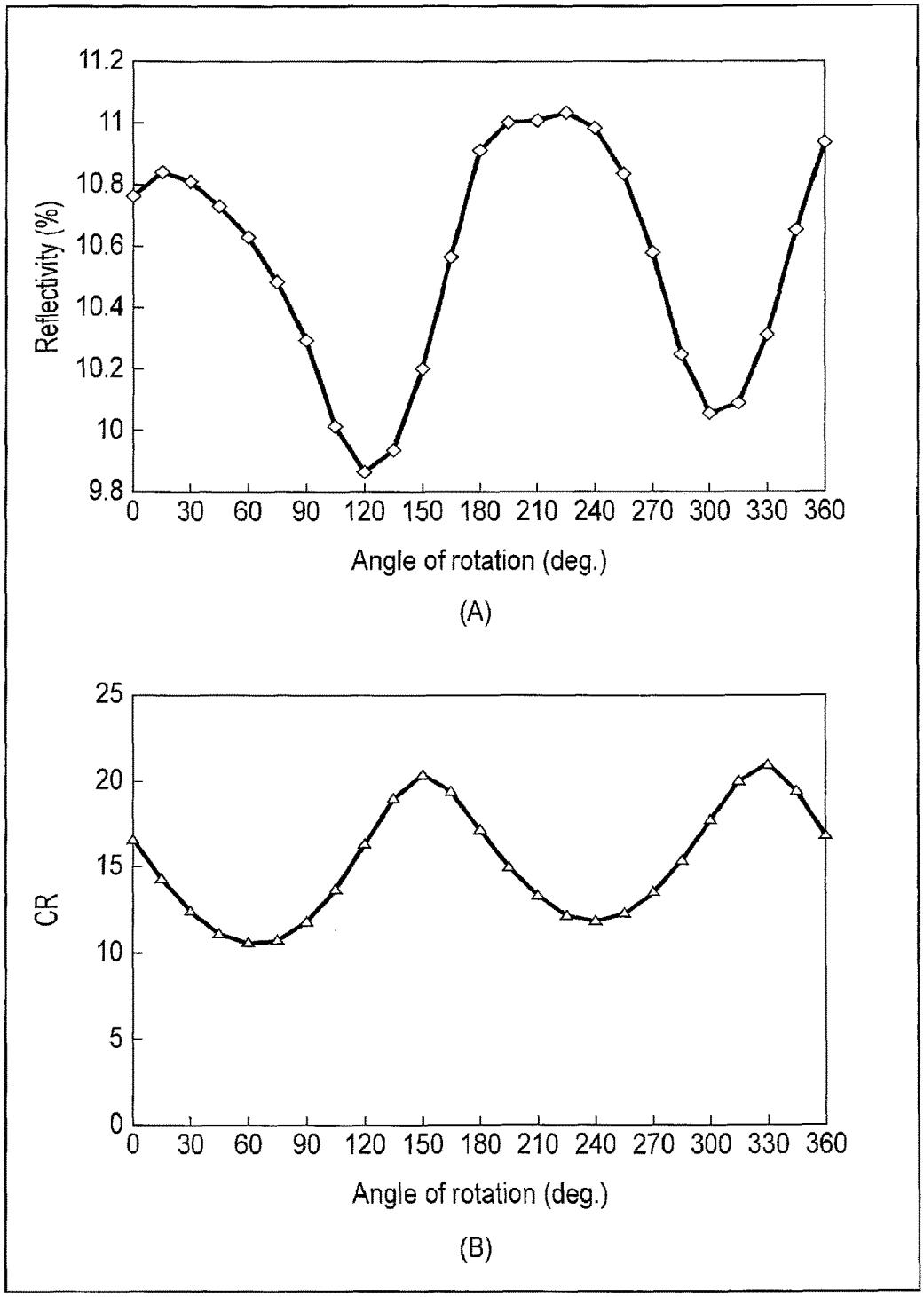
FIG. 17 shows experiment results and, more specifically, (A) shows a measurement result of the reflectivity (%) to the angle of rotation θ and (B) shows a measurement result of the contrast ratio to the angle of rotation θ.

FIG. 17 shows experiment results and, more specifically, (A) shows a measurement result of the reflectivity (%) to the angle of rotation θ and (B) shows a measurement result of the contrast ratio to the angle of rotation θ. As shown in the figure, the angle of rotation at which a high reflectivity can be obtained does not necessarily correspond to the angle of rotation at which a high contrast ratio can be obtained. It was recognized based on the experiment results shown in the figure that the optical properties such as the reflectivity and the contrast ratio became preferable when the angle of rotation was greater than 150° and smaller than 180°. The angle of rotation θ was set at 158.5° as one of the conditions for optimizing the optical properties. In contrast, the column-inversion drive scheme in which the polarities of the main pixels adjacent in the first direction D1 were different from each other was applied to the experiment. No display failure resulting from the disclination was recognized when the angle of rotation θ was set at 68.5°, but the display failure resulting from the disclination was recognized when the angle of rotation θ was set at 158.5°. In other words, the angle of rotation θ for optimizing the optical properties such as the reflectivity and the contrast ratio did not match the angle of rotation θ for suppressing the disclination.

In the present embodiment, a method of suppressing the disclination while setting the angle of rotation θ) (=158.5° for optimizing the optical properties will be reviewed. The disclination may often occur when the polarities of the pixels adjacent in the first direction D1 are different from each other. For this reason, the disclination can be suppressed by applying the line-inversion drive scheme in which the polarities of the pixels arranged in the first direction D1 are the same as each other. However, the line-inversion drive scheme has a problem in that the energy consumption is increased in comparison with the column-inversion drive scheme. In the present embodiment, as described above, the pixel layouts represented by those shown in FIG. 3, FIG. 7, FIG. 13, FIG. 14 and the like are adopted and the pseudo-line-inversion drive scheme of arranging the polarities of the respective sub-pixels constituting the pixel lines is applied while substantially applying the column-inversion drive scheme. Since all the polarities of the sub-pixels constituting one pixel line thereby become the same as each other, an undesired lateral electric field between the adjacent sub-pixels can be suppressed and the disclination can also be suppressed. In other words, the display quality can be improved by optimizing the optical properties and suppressing the disclination. In addition, the energy consumption can be reduced by applying the column-inversion drive scheme to the embodiment.

Figure 18:
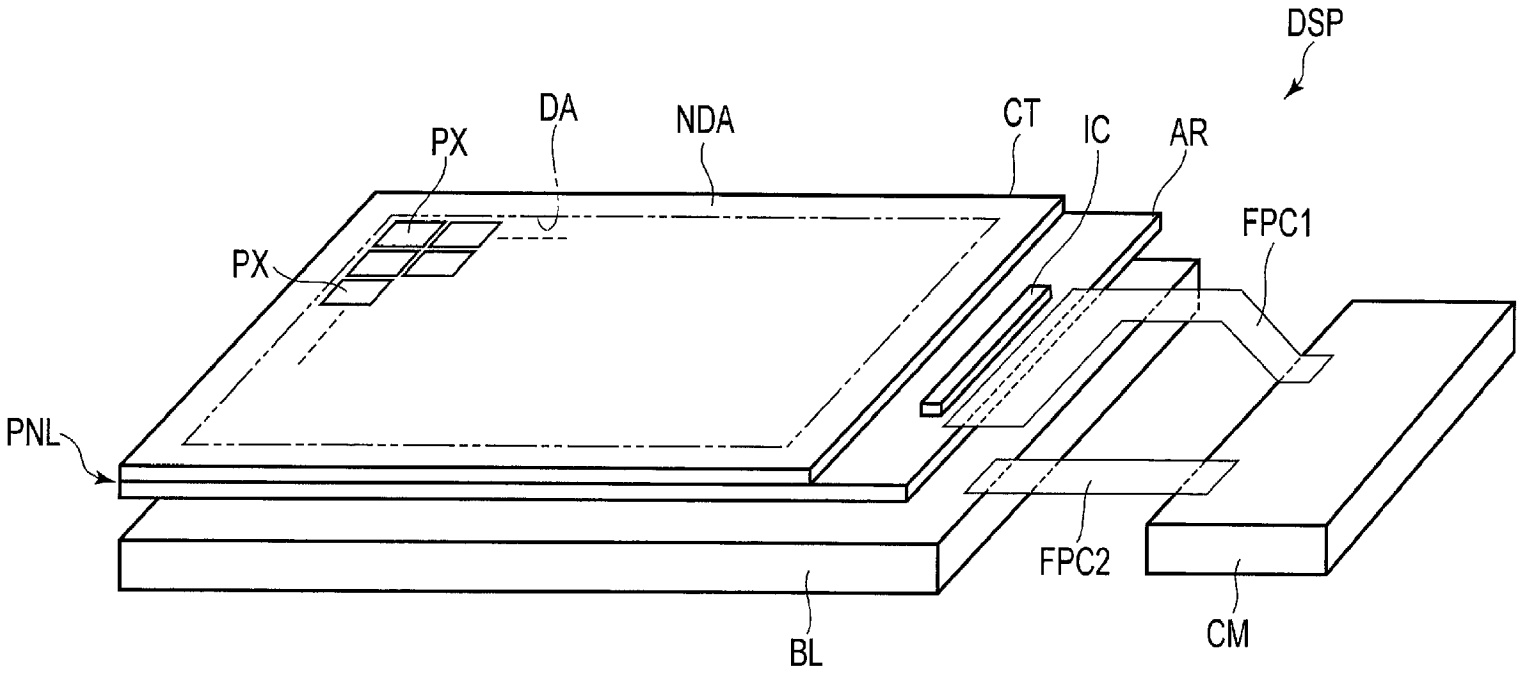
FIG. 18 is a perspective view schematically showing another configuration of the liquid crystal display device DSP.

FIG. 18 is a perspective view schematically showing another configuration of the liquid crystal display device DSP.

The liquid crystal display device DSP comprises an active-matrix liquid crystal display panel PNL, a driving IC chip IC which drives the liquid crystal display panel PNL, a backlight unit BL which illuminates the liquid crystal display panel PNL, a control module CM, flexible printed-circuit boards FPC1 and FPC2, and the like.

The backlight unit BL is disposed on the back surface side of the liquid crystal display panel PNL. Various types of units are applicable as the backlight unit BL, but the detailed explanations of their structures are omitted. The flexible printed-circuit board FPC1 connects the liquid crystal display panel PNL and the control module CM. The flexible printed-circuit board FPC2 connects the backlight unit BL and the control module CM.

The liquid crystal display panel PNL is a transmissive display panel having a transmissive display function to display an image by selectively transmitting the light from the backlight unit BL by each main pixel PX or a transreflective display panel having the transmissive display function and the reflective display function. Any one of the above-explained examples can be applied as the layout of the sub-pixels included in each main pixel PX.

As described above, the present embodiment can provide the display device capable of improving the display quality and reducing the energy consumption.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device, comprising:

a first main pixel including a first sub-pixel, a second sub-pixel arranged in a first direction of the first sub-pixel, and a third sub-pixel arranged in a second direction of the first sub-pixel;

a second main pixel including a fourth sub-pixel arranged in the first direction of the third sub-pixel, a fifth sub-pixel arranged in the second direction of the third sub-pixel, and a sixth sub-pixel arranged in the first direction of the fifth sub-pixel;

a scanning line group including a plurality of scanning lines;

a signal line group including a plurality of signal lines; and a display driver which produces video signals to be written to the respective sub-pixels of the first and second main pixels and supplies the video signals to the respective sub-pixels via the signal lines, wherein any one of the first to third sub-pixels and any one of the fourth to sixth sub-pixels share one of the signal lines, are arranged in the second direction, and exhibit different colors, the scanning line group includes first to third scanning lines arranged in order in the first direction, the signal line group includes first to fourth signal lines arranged in order in the second direction, the first sub-pixel is electrically connected with the first scanning line and the first signal line, the second sub-pixel is electrically connected with the second scanning line and the second signal line, the third sub-pixel is electrically connected with the second scanning line and the third signal line, the fourth sub-pixel is electrically connected with the third scanning line and the second signal line, the fifth sub-pixel is electrically connected with the first scanning line and the third signal line, the sixth sub-pixel is electrically connected with the second scanning line and the fourth signal line, a polarity of the video signals supplied to each of the first and third signal lines is a first polarity, a polarity of the video signals supplied to each of the second and fourth signal lines is a second polarity opposite to the first polarity, the first sub-pixel, the third sub-pixel, and the fifth sub-pixel are arranged in the second direction, and the video signals of the first polarity are written to the first sub-pixel, the third sub-pixel, and the fifth sub-pixel, respectively, and the second sub-pixel, the fourth sub-pixel, and the sixth sub-pixel are arranged in the second direction, and the video signals of the second polarity are written to the second sub-pixel, the fourth sub-pixel, and the sixth sub-pixel, respectively.

2. The display device of claim 1, wherein the signal line group includes first to fourth signal lines, the display driver comprises a signal processor which outputs the video signals, a line buffer which temporarily stores some of the video signals output from the signal processor, a first output terminal and a second output terminal which are electrically connected with the signal processor and the line buffer, a first switch interposed between the first signal line and the first output terminal, and between the second signal line and the second output terminal, and a second switch interposed between the third signal line and the first output terminal, and between the fourth signal line and the second output terminal, and the display driver sets the first switch and the second switch to be conductive in different periods of a horizontal scanning period, respectively, and outputs the video signals stored in the line buffer or the video signals directly output from the signal processor to each of the first to fourth signal lines.

3. The display device of claim 1, wherein each of the first to sixth sub-pixels has a shape extending in the second direction.

4. The display device of claim 1, wherein the first and fourth sub-pixels exhibit a first color, the second and fifth sub-pixels exhibit a second color different from the first color, and the third and sixth sub-pixels exhibit a third color different from the first and second colors.

5. The display device of claim 1, wherein the first and fifth sub-pixels exhibit a first color, the second and sixth sub-pixels exhibit a second color different from the first color, the third sub-pixel exhibits a third color different from the first and second colors, and the fourth sub-pixel exhibits a fourth color different from the first to third colors.

6. The display device of claim 5, wherein the display driver produces a corrected video signal by averaging the video signal for the third color of the first main pixel and the video signal for the third color of the second main pixel.

7. The display device of claim 1, wherein the first and fourth sub-pixels exhibit a first color, the second and fifth sub-pixels exhibit a second color different from the first color, and the third and sixth sub-pixels exhibit a third color different from the first and second colors.

8. The display device of claim 1, wherein each of the sub-pixels includes a reflective electrode.

* * * * *